United States Patent [19]

Stubbe et al.

[11] Patent Number: 4,584,918

[45] Date of Patent: Apr. 29, 1986

[54] PORTABLE SAWMILL

[76] Inventors: Richard J. Stubbe, 9136 E. Artesia Blvd., No. 4, Bellflower, Calif. 90706; Kenneth C. Stubbe, 1376 Purdue St., Upland, Calif. 91786

[21] Appl. No.: 638,960

[22] Filed: Aug. 8, 1984

[51] Int. Cl.[4] ..... B27B 7/02

[52] U.S. Cl. ..... 83/471.3; 83/486.1; 83/488; 83/743; 83/578

[58] Field of Search ..... 83/471.3, 486.1, 488, 83/574, 743, 745, 578

[56] References Cited

U.S. PATENT DOCUMENTS

| | | | |
|---|---|---|---|
| 1,842,114 | 1/1932 | Pratt | 83/488 |
| 2,254,293 | 9/1941 | Kaehlert | 83/488 X |
| 4,235,140 | 11/1980 | Reece | 83/574 |
| 4,454,794 | 6/1984 | Thornton | 83/488 X |

*Primary Examiner*—Donald R. Schran
*Attorney, Agent, or Firm*—Charles H. Thomas

[57] ABSTRACT

A portable sawmill is constructed to produce dimensioned lumber from logs in remote logging locations. The portable sawmill employs but a single, disk shaped rotating blade which is powered by a relatively low horsepower engine. The engine and blade are mounted upon a carriage which traverses the length of a log to effectuate first a horizontal cut and then a vertical cut with a single saw blade in returning along the length of the log. The blade is oriented for vertical cutting as it progresses along the track away from the operator. The orientation of the blade is automatically reversed at the remote end of the log. The saw blade then cuts the log while in a horizontal orientation as it returns to the operator position. The maximum speed of longitudinal traverse of the carriage is separately adjustable for both vertical and horizontal cuts. The operator is able to control engagement and disengagement of the longitudinal drive mechanism from the operator position at any position of the carriage along the log, so as to continuously adjust the carriage speed up to the maximum established.

19 Claims, 17 Drawing Figures

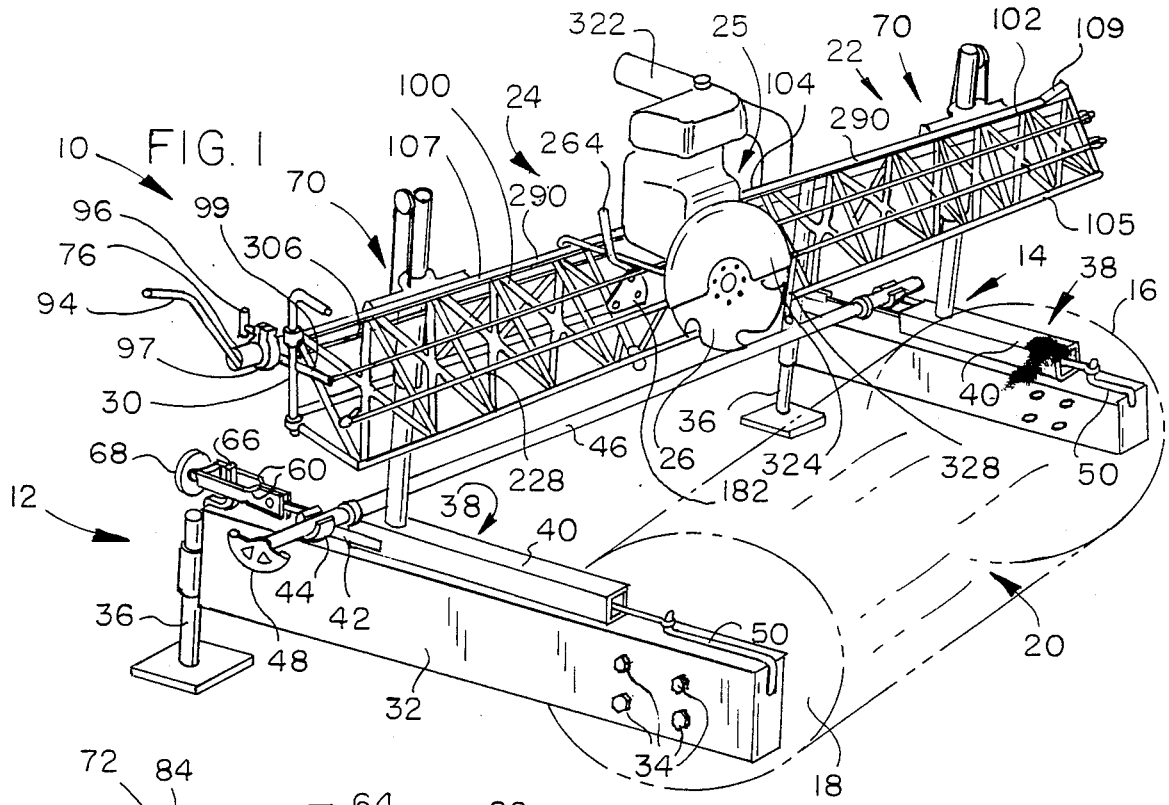
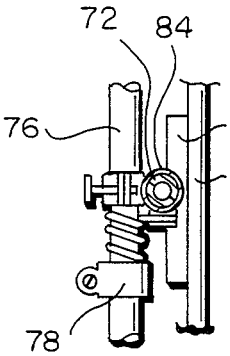
FIG. 3
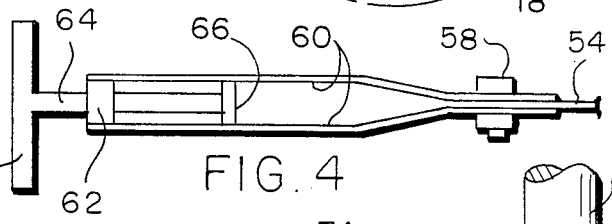
FIG. 4
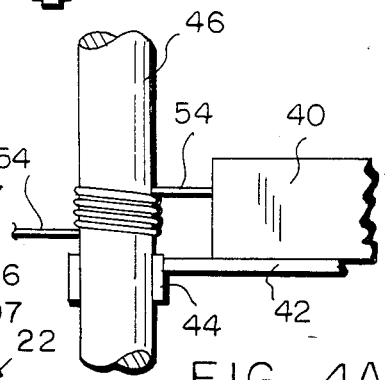
FIG. 4A
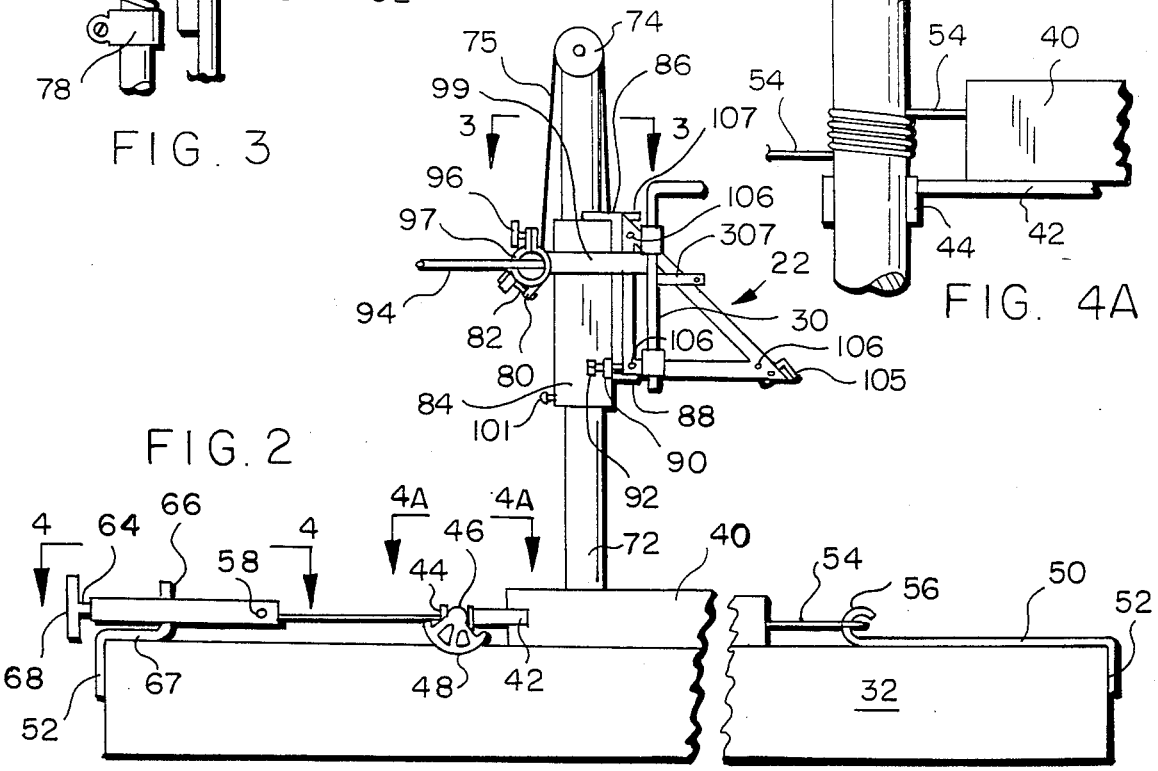

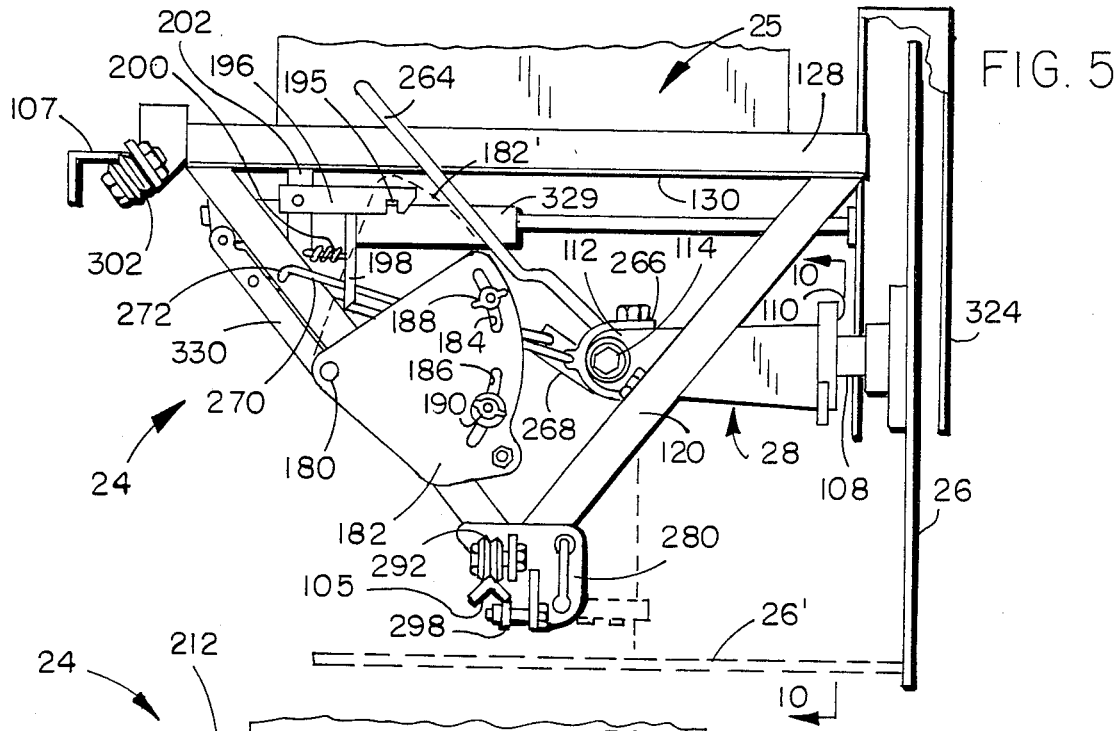
FIG. 5
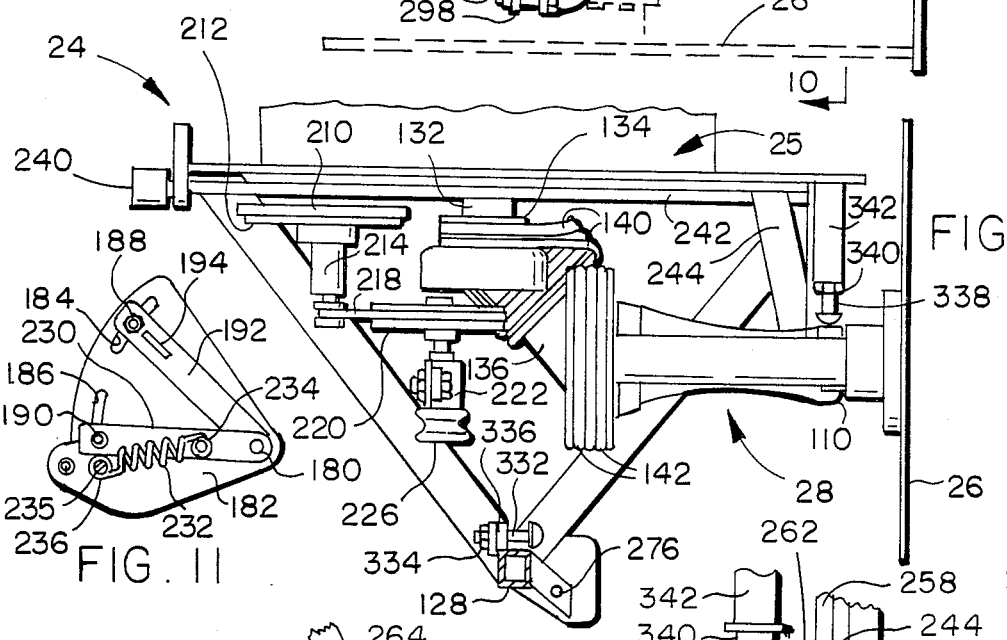
FIG. 7
FIG. 11
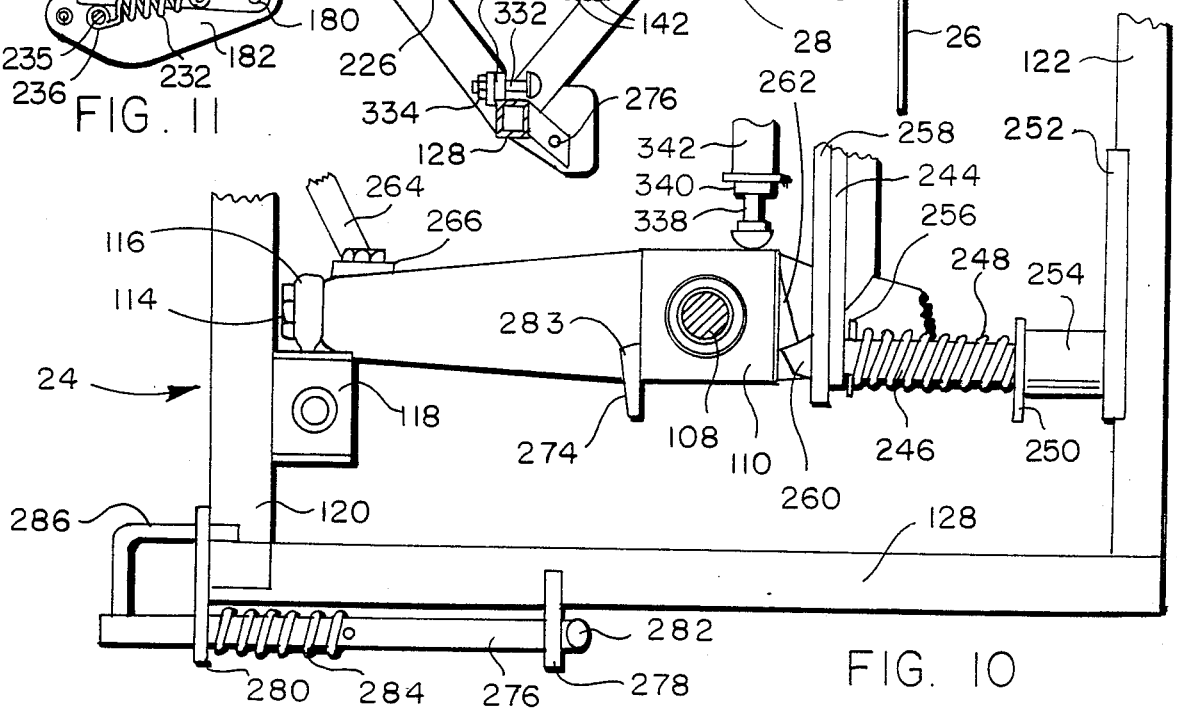
FIG. 10

PORTABLE SAWMILL

BACKGROUND OF THE INVENTION

1. Field of the Invention

The present invention relates to portable sawmills and devices for cutting dimensional lumber from rough logs.

2. Description of the Prior Art

Various portable lumber sawing machines have been devised for cutting dimensioned lumber from rough logs. However, the machines of this type which have heretofore been available are of limited capacity, or are excessively heavy and difficult to transport, erect and disassemble.

Some prior art devices which have been devised are described in U.S. Pat. Nos. 2,609,848 and 3,398,771. Other portable lumber milling devices which are available include the H and M Series Saw Mills manufactured by Mighty Mite of Portland, Oreg.; the Models 12, 127 and 128 manufactured by Mobile Manufacturing Company of Troutdale, Oreg.; the Model 249 Band Saw, manufactured by Wood-Mizer of Indianapolis, Ind.; the Lumberjack Saw Mill Model 800, manufactured by Brown Engineering Company of Westpoint, Calif.; the Model M-14 Saw Mill manufactured by Foley-Belsaw Co. of Kansas City, Mo.; the Mil-Rite Chain Saw Mill manufactured by Harriston Industries of Minto, N. Dak.; the Bumble Bee Saw Mill System, manufactured by Woodland Manufacturing, Inc., of Cambridge, Id.; and the Nordic Prince Portable Saw Mill manufactured by North American Commerce Group, Ltd., of Portland, Oreg.

SUMMARY OF THE INVENTION

The present invention is a portable sawmill which employs but a single blade for effectuating both horizontal and vertical cuts By utilizing only a single cutting blade, only a relatively light weight, compact, low horsepower engine is required. One embodiment of the portable sawmill according to the invention can saw dimensional lumber from logs of any cross sectional size using only a ten horsepower engine. The weight of this embodiment of the entire portable sawmiIl according to the invention is only about 350 pounds. In contrast, a prior art portable sawmill, capable of heavy duty work to mill lumber from large logs, weighs approximately 1900 pounds. The portable sawmill of the invention is thereby far easier to transport, set up, and disassemble than any conventional portable sawmill which has heretofore been available.

A further advantage of the sawmill of the present invention is that by employing but a single blade to cut dimensional lumber from rough logs, there is no limit on the diameter of logs which can be milled. Commercially available devices designed to cut large logs are limited in their capacity because they employ a plurality of blades which must be maintained in an orthogonal relationship. However, by employing a single blade, the portable sawmill of the present invention is able to cut lumber of any dimensions from logs of any cross sectional size. Indeed, a very large log may well form a supporting structure upon which the track of the invention is mounted, as will hereinafter be described.

The depth of both vertical and horizontal cuts to produce dimensioned lumber is limited only by the diameter of the circular blade employed. Separate maximum speeds for longitudinal carriage movement can be established by the operator at a single operator position for both vertical and horizontal cuts. Within the limits established the operator of the portable sawmill has complete control over the rate of longitudinal traverse of the carriage upon which the saw blade is mounted at all times from a single position. The operator can therefore slow the speed of longitudinal movement of the carriage for deep cuts and for hard wood, and increase the speed of longitudinal movement of the carriage for shallower cuts and for softer wood.

The longitudinal driving force to advance the saw blade carriage up and down the track is provided by the same engine which powers the saw blade through a power take-off and carriage propulsion system. By varying tension on a control cable from a single lever at the operator position, the operator can vary the speed of longitudinal movement of the carriage anywhere between a standstill and the maximum speed established for the cut being effectuated. The flexibility to continuously vary the speed of longitudinal progression of the blade carriage by the operator allows the operator to successfully negotiate the movement of the saw blade through burls and hard spots in a log without halting movement of the carriage and without leaving the operator position.

When the carriage has traveled from the operator position and clears the remote end of the log, an automatic trip mechanism releases the arbor holding the saw blade, and allows the arbor and blade to drop under the force of gravity to an orthogonal cutting position. Moreover, the cutting orientation reversing mechanism is coupled to the longitudinal drive mechanism to automatically reverse the direction in which the carriage is driven along the track. Furthermore, a throttle control is preferably coupled to the cutting orientation and longitudinal directional reversing mechanisms to throttle down the sawmill engine as the blade orientation is reversed The track mechanism is of modular construction for ease of transport and assembly. Preferably, the track employs two ten foot sections and a four foot section. The four foot section serves as a convenient means of lifting the carriage. In the embodiment of the invention employing a ten horsepower engine and a sixteen inch blade the heaviest component of the portable sawmill which must be lifted separately weighs only 85 pounds. This embodiment can be used to cut lumber up to nominal dimensions of six inches by six inches. Lumber of larger dimensions may be cut using a twenty four inch blade powered by an eighteen horsepower engine.

The invention may be described with greater clarity and particularity by reference to the accompanying drawings.

DESCRIPTION OF THE DRAWINGS

FIG. 1 is a perspective view of a portable sawmill according to the invention.

FIG. 2 is a side elevational view of the track and mounting mechanisms of the portable sawmill of FIG. 1.

FIG. 3 is a sectional plan detail taken along the lines 3—3 of FIG. 2.

FIG. 4 is a plan detail taken along the lines 4—4 of FIG. 2.

FIG. 4A is a plan detail taken along the lines 4A–4A of FIG. 2.

FIG. 5 is a front elevational view of an embodiment of the carriage of the portable sawmill of FIG. 1.

FIG. 7 is a sectional elevational view taken along the lines 7—7 of FIG. 6.

FIG. 10 is a right side sectional elevational view taken along the lines 10—10 of FIG. 5.

FIG. 11 is an elevational detail taken along the lines 11—11 of FIG. 6.

Figures 6, 8, 9, 12:
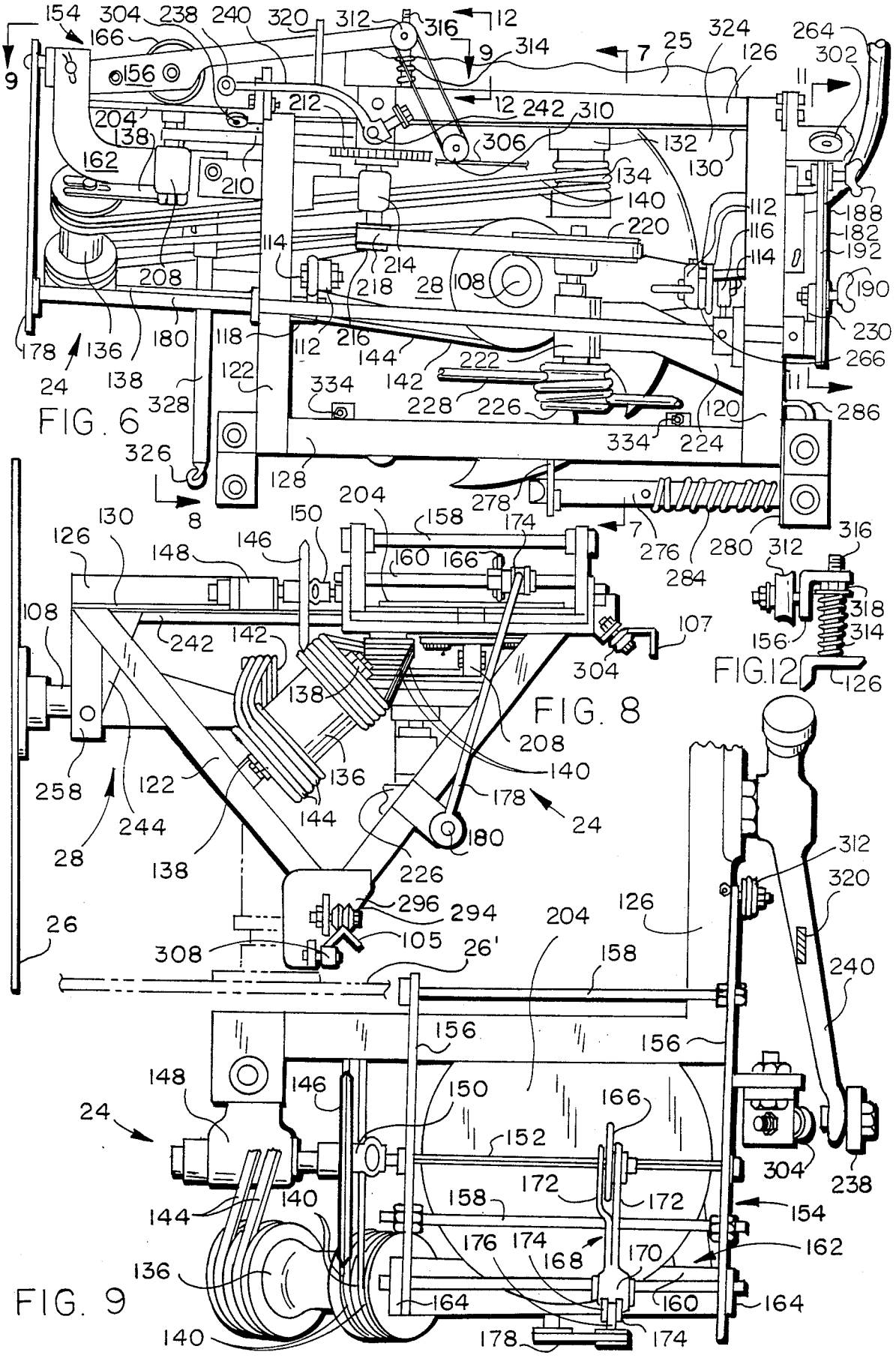
FIG. 6 is a left side elevational view of the carriage of FIG. 5.
FIG. 8 is a rear elevational view of the carriage of FIGS. 5-7.
FIG. 9 is a plan view of a portion of the carriage of FIGS. 5-8 taken along the lines 9—9 of FIG. 6.
FIG. 12 is an elevational detail taken along the lines 12—12 of FIG. 6.

Due to the intricacy of the mechanical components of the embodiments of the invention depicted, certain structures in the background of some of the drawing views have been omitted from some of the drawing figures so that the structure and operation of components in the foreground can be more clearly described.

DESCRIPTION OF THE EMBODIMENTS

FIG. 1 illustrates a portable lumber milling machine 10 constructed according to the invention. The lumber milling machine 10 is formed of a pair of mountings 12 and 14 each having corresponding horizontally and vertically adjustable components which are designed for securement relative to the ends 16 and 18 of a log 20, which is a section of cut timber, shown in phantom in FIG. 1. The mountings 12 and 14 extend in spaced transverse disposition relative to the alignment of the log 20. A track assembly 22, formed as a longitudinally elongated truss having a triangular cross sectional shape, is attached to the mountings 12 and 14 to extend parallel to the alignment of the log 20. A carriage 24, constructed with an open framework generally in the shape of a triangular prism, rides upon the track assembly 22, and an engine 25 is mounted upon the carriage 24. A saw blade 26 is driven by the engine 25.

As best illustrated in FIGS. 5-10, a supporting arbor 28 is provided on the carriage 24 and is rotatable relative thereto about a longitudinal axis to alternatively carry the saw blade 26 in a vertical orientation, as indicated in solid lines in FIG. 5, and in a horizontal orientation indicated at 26' in FIG. 5. A longitudinal drive mechanism, which will hereinafter be described, is also provided and is operable by an operator located at one end of the track assembly 22 by means of an operating lever 30, depicted in FIG. 1 An operator standing at the end of the track assembly 22 is able to rotate the lever 30 to control movement of the carriage 24 along the track assembly 22. A saw blade orientation reversing mechanism, which will also hereinafter be described, initiates rotation of the supporting arbor 28 relative to the carriage 24 at a predetermined position along the track assembly 22 to change the orientation of the saw blade 26 as between the dispositions indicated at 26 and 26' in FIG. 5. The predetermined position at which the blade disposition reversing means operates will always be beyond the end 16 of the log 20.

There are several important aspects to the pair of mountings 12 and 14. Each of the mountings 12 and 14 includes means for adjusting the location of the track assembly 22 relative to the log 20 in both of two mutually perpendicular directions. Specifically, the track assembly 22 is maintained in parallel alignment with the log 20 and both the horizontal and vertical displacement of the track 22 from the log 20 are adjusted.

Adjustment for Depth of Horizontal Cuts

Each of the mountings 12 and 14 includes a horizontal adjustment mechanism 38 employing a heavy beam 32 which is arranged in a transverse disposition relative to the ends 16 and 18 of the log 20 of timber which is to be cut into dimensioned lumber. The beams 32 are preferably wooden beams. The beams 32 may be attached low on the ends of a large log 20 by means of four lag bolts 34 which pass through the beam structure at one end thereof and into the ends 16 and 18 of the log 20. The opposite ends of the beams 32 are not fastened to the log 20, but are supported by vertically adjustable struts 36 which rest firmly upon the earth. For smaller logs there is no necessity to attach the beams 32 to the log ends 16 and 18. Rather, the beams 32 are positioned in a very stable manner upon the earth in spaced separation from each other and in perpendicular orientation relative to the alignment of a log to be cut. Each horizontal adjusting mechanism 38 includes a length of two inch by two inch steel tubing 40 having a wall thickness of ¼ inch. A steel strap 42 is welded to one side of each tubing section 40 to extend toward one end of the support beam 32 upon which the section of tubing 40 resides. A U-shaped steel cradle 44, opening upwardly, is welded to each of the straps 42. The sections 40 of square steel tubing are adjusted along the support beams 32 until the cradles 44 thereof are disposed in longitudinal alignment parallel to the alignment of the log 20. An elongated, hollow horizontal control rod 46, having a rotatable crank or hand wheel 48 thereon, rests in longitudinal alignment with the log 20 in the cradles 44, as illustrated in FIGS. 1, 2 and 4A.

At one end of each horizontal adjustment mechanism 38 there is a cable anchor rod 50 which is bent into hooks 52 and 56 at opposite ends. The hook 52 fits into a bore drilled into the structure of the support beam 32 to secure the cable anchor rod 50 relative thereto. A crimped eye is formed in the end of a horizontal adjustment control cable 54 to fit over the hook 56 at the opposite end of the cable anchor rod 50.

The horizontal adjustment control cable 54 extends toward the opposite end of the beam 32 through the tube 40 and terminates in another crimped eye through which the shank of a bolt 58 passes, as best depicted in FIG. 4. The bolt 58 passes through aligned apertures in a pair of straps 60, which are bent to create a separation remote from the horizontal adjustment control cable 54. A nut 62 is welded to the straps 60 to receive the threaded shank of a tensioning screw 64. The end of the shank of the tensioning screw 64 bears against an upright flange 66 on a bent cable adjuster anchor 67, depicted in FIG. 2. The opposite end of the cable adjustment anchor 67 is formed into a hook 52 to extend into a bore in the structure of the support beam 32.

In setting up the horizontal adjustment mechanism 38, the eye on one end of the horizontal adjustment control cable 54 is slipped over the hook 56 of the cable anchor rod 50. The horizontal adjustment control cable 54 is then passed through the hollow square steel tube 40 and helically wound in several turns about the horizontal adjustment control rod 46 so that the horizontal adjustment control rod 46 will not slip relative to the cable 54 when the horizontal adjustment hand wheel 48 is turned. The eye at the other end of the cable 54 is then positioned in alignment with the aligned apertures in the straps 60, as depicted in FIG. 4, once the handle 68 of the tensioning screw 64 has been turned to back the shank of the screw 64 off from the flange 66. This provides sufficient slack in the cable 54 so as to allow the bolt 58 to be easily inserted through the aligned apertures in straps 60 and through the eye in the proximate end of the cable 54. The handle 68 of the tensioning screw 64 is then turned to apply tension to the horizontal adjustment control cable 54 by drawing the nut 62 away from the flange 66, as best depicted in FIGS. 2 and 4.

To initially position the track assembly 22 parallel to the log 20, the tensioning screw 64 of the horizontal adjustment mechanism 38 proximate to the end 16 of the log 20 is first tightened so that the shank thereof bears against the flange 66 to exert tension on the cable 54. The horizontal adjustment control rod 46 is then rotated to move the length of steel tubing 40 that is proximate to the end 16. The other length of steel tubing 40 will not move until tension is placed on the cable 54 at the operator end. Once the track assembly 22 is in parallel alignment with the log 20, the tensioning screw 64 at the operator end 18 is tightened so that the sections of steel tubing 40 will move transversely along the support beams 32 in tandem, and the track assembly 22 will remain in parallel alignment with the log 20.

By rotating the hand wheel 48 the horizontal adjustment control rod 46 is rotated to adjust the horizontal position of the steel tubing sections 40 along the lengths of the support beams 32. That is, if the hand wheel 48 is rotated counterlockwise as viewed in FIG. 2, the horizontal adjustment control rod 46 will take up on that portion of the cable 54 to the left of the U-shaped cradle 44, and will release the portion of the able 54 to the right thereof, as viewed in FIGS. 2 and 4A. Since the steel tubing section 40 is welded to the strap 42, which in turn is welded to the U-shaped cradle 44, the steel tubing section 40 will be pulled to the left as viewed in FIGS. 2 and 4A. Conversely, when the hand wheel 48 is rotated clockwise, as viewed in FIG. 2, the horizontal adjustment control rod 46 will take up on that portion of the cable 54 to the right of the cradle 44 and release the portion of the cable 54 to the left thereof. As a consequence, the steel tubing section 40 will advance to the right, as viewed in FIGS. 2 and 4A.

Since there is a horizontal adjustment control cable 54 wrapped around both ends of the horizontal adjustment control rod 46, both ends of the track assembly 22 will be moved horizontally in tandem so as to maintain the track assembly 22 in parallel alignment with the log 20.

By rotating the hand wheel 48 to move the lengths of steel tubing 40 to the left or right, as viewed in FIGS. 2 and 4A, the depth of the cut of the saw blade 26 into the log 20, when in the horizontal orientation indicated at 26' in FIG. 5, can be adjusted. Preferably, gauge marks in units of measurement corresponding to dimensions of lumber to be cut are provided along the tops of the support beams 32 to aid the operator in effectuating the proper horizontal adjustment at the termination of each pass and return of the carriage 24 to and from the remote end of the track assembly 22.

Adjustment for Depth of Vertical Cuts

Each of the mountings 12 and 14 also includes a vertical adjustment mechanism 70. A cylindrical length of steel pipe 72 extends upwardly in a column perpendicular to the square steel tubing sections 40 at each end of the portable sawmill 10. A pulley 74 is located at the top of each vertical column 72 and one end of a vertical adjustment control cable 75 is secured to the track assembly 22 and is looped over the pulley 75. The opposite end of the vertical adjustment cable 75 is secured to an elongated longitudinally oriented vertical adjustment rod 76 by means of a clamp 78, as depicted in FIG. 3.

The vertical adjusting rod 76 extends parallel to the track mechanism 22 and is received within a pair of U-shaped brackets 80, angled downwardly relative to the horizontal, as best depicted in FIG. 2. Bolts 82 pass through apertures aligned in the legs of the U-shaped brackets 80 so that the vertical adjustment rod 76 is captured therewithin.

The backs of the U-shaped brackets 80 are welded to steel sleeves 84 which slide vertically along the upright columns 72. Opposite the brackets 80 the backs of angle sections 86 are welded to the sleeves 84 and extend longitudinally also parallel to the track mechanism 22, about four inches to both sides of the sleeves 84. The angle sections 86 are provided with apertures which accommodate bolts that are used to secure the track assembly 22 to the sleeves 84.

A horizontally projecting tab 88 is welded to the bottom of each sleeve 84, as illustrated in FIG. 2. The track assembly 22 rests atop the tab 88. A nut 90 is also welded to each sleeve 84 just above the tab 88, and an alignment adjustment screw 92 is threadably engaged in each nut 90. The alignment adjustment screws 92 are used to make fine adjustments to correct for slight vertical misalignments which may occur when the track assembly 22 is bolted to the angles 86.

Vertical adjustments in the elevation of the track assembly 22 are performed by turning the vertical adjustment control rod 76 by means of the vertical adjustment crank handle 94 at the operator end of the track mechanism 22. As viewed in FIG. 2, clockwise rotation of the handle 94 will turn the vertical adjustment rod 76 and cause it to wind up the cable 75. As the cable 75 is wound in wraps about the vertical adjustment control rod 76, as illustrated in FIG. 3, the sleeve 84 is carried upwardly on the vertical column 72, thereby increasing the elvation of the track assembly 22. Conversely, counterclockwise rotation of the handle 94 will allow the sleeve 84 to descend upon the column 72, thereby lowering the elevation of the track assembly 22. The track assembly 22 is locked at a desired vertical elevation by tightening the thumbscrew 96 which is threadably engaged in clamping collar 97 which is welded to transverse steel strap 99 at the operator end of track assembly 22. When the thumbscrews 96 are tightened, the clamping collars 97 prevent the vertical adjustment rod 76 from rotating. Thumbscrews 101, threadably engaged in the sleeves 84, may also be used to prohibit vertical movement of the sleeves 84 along the columns 72.

The vertical adjustment mechanisms 70 allow the depth of a vertical cut of the blade 26 to be adjusted when the blade 26 is in the vertical cutting position depicted in solid lines at 26 in FIG. 5. Preferably, the vertical columns 72 are provided with graduated markings to assist in making the proper vertical adjustments so as to correctly cut dimensioned lumber to size. Like the horizontal adjustment mechanisms 38, the vertical adjustment mechanisms 70 are both operable in tandem from one end of the track assembly 22. All of the horizontal adjusting mechanisms 38 and the vertical adjusting mechanisms 70 are operable from the same operator end of the track assembly 22.

The Track Assembly

The track assembly 22 is preferably formed of a plurality of track sections releasably secured together between the mountings 12 and 14. The track assembly 22 may, for example, be formed of two ten foot sections 100 and 102, and a four foot section 104, all configured as trusses which are of uniform triangular cross section. The sections 100, 104 and 102 are secured together by longitudinally oriented bolts which secure the truss sections in longitudinal abutment and which pass through holes in the angle segments forming the trusses. Some of these bolts are indicated at 106 in FIG. 2. The truss sections 100, 102, and 104 are bolted together by the operator prior to use and prior to being bolted to the angles 86 on the sleeves 84. The short rail section 104 serves two purposes. First, it is a convenient carrying support for the carriage 24. Secondly, it attaches to the longer sections 100 and 102 to increase the total length of the track assembly 22, this allows longer logs 20 to be cut.

The track sections 100, 104 and 102 together define a pair of longitudinal carriage support rails 105 and 107, constructed of angle iron segments and oriented as indicated in FIG. 2. A steel wedge 109 is bolted to the remote end of the top surface of the support rail 107 on the track section 102 to form a cam surface. This cam surface extends transversely relative to the alignment of the support rail 107. The cam formed by the wedge 109 serves as a trip mechanism to change the orientation of the saw blade 26 and to reverse the direction of carriage movement, as will hereinafter be described.

The Carriage

The carriage of the portable sawmill 10 is an extremely important feature of the invention. A preferred embodiment of the carriage is illustrated at 24 in FIGS. 5–12. The saw blade 26 is a rotary, disk shaped blade about sixteen inches in diameter and is secured to a rotatable shaft 108 which is carried in bearings located within a supporting arbor 28. The arbor 28 is formed in a generally triangular shaped configuration. The apex of the arbor 28 forms a bearing mount 110 proximate to the saw blade 26, while inwardly projecting ears 112 are provided at the other two corners of the arbor 28. The ears 112 are disposed in longitudinal alignment and are rotatably secured by means of bolts 114 which pass through steel rings 116 that have threaded shanks which are locked by nuts to mounting flanges 118 that in turn are welded to the framework of the carriage 24. As best illustrated in FIGS. 5 and 6, the arbor 28 which supports the saw blade 26, is rotatable relative to the carriage 24 about a longitudinal axis passing along the shanks of the bolts 114. This axis is spaced from the saw blade 26 a distance equal to the radius of the saw blade 26.

The carriage 24 is formed with a steel framework which defines a pair of inverted, triangular shaped vertically disposed end sections 120 and 122, both visible in FIG. 6. The triangular sections 120 and 122 are formed of square sections of tubular steel joined at the top by a horizontally disposed rectangular supporting frame 126, also formed of lengths of square steel tubing, and at the bottom by a single length of square steel tubing 128. A steel pan 130, visible in FIGS. 5 and 6, is welded to the underside of the rectangular frame 128 of steel tubing at the top of the carriage 24. The pan 130 has oblong, longitudinally disposed mounting slots therewithin. Bolts extending through feet of the engine base pass through the slots in the pan 130. The oblong configuration of the mounting slots in the pan 130, allows some longitudinal adjustment in positioning the engine 25 atop the carriage 24. In the embodiment of the invention of FIGS. 5–12 the engine 25 is a single cylinder, ten horsepower gasoline driven engine manufactured by Tecumseh Products Co. of Grafton, Wisconsin.

An engine drive shaft 132 carrying a double belt pulley 134 thereon extends vertically downward through an opening in the pan 130. The pulley 134 is mounted on a centrifugal clutch (not visible) which is mounted on the engine drive shaft 132. When the engine 26 is operated, the drive shaft 132 turns in rotation, as does the double belt pulley 134. The engine drive shaft 132 and pulley 134 have been omitted from FIG. 5 to allow other features of the invention to be illustrated more clearly, but the shaft 132 and pulley 134 are both visible in FIGS. 6 and 7.

The engine 25 drives the saw blade 26 through a belt drive system employing a countershaft pulley 136, best depicted in FIGS. 6, 8 and 9. The countershaft pulley 136 is mounted between a pair of rearwardly extending mounting forks 138 which are welded to the frames 122 and 126. The countershaft pulley 136 is mounted at an angle of 45 degrees relative to the axis of rotation of the engine drive shaft 132 and the double belt pulley 134. The countershaft pulley 136 is driven by the pulley 134 through two V-belts 140.

A double belt pulley 142 is mounted on the inward extremity of the saw blade drive shaft 108. The double belt pulley 142 is driven by a pair of belts 144 from the lower end of the countershaft pulley 136. When the saw blade 26 is vertically oriented, the pulley 142 is likewise vertically oriented and is located at an angle of 45 degrees in one direction relative to the countershaft pulley 136, as illustrated in FIG. 8. When the saw blade 26 is horizontally oriented, as indicated at 26' in FIG. 8, the pulley 142 is also horizontally oriented, but is still at an angle of 45 degrees relative to the countershaft pulley 136, but in the opposite direction of orientation. The belt drive system of the embodiment of FIGS. 5–12 is thereby able to accommodate the change in orientation of the saw blade drive shaft 108 in both of the alternative, orthogonal positions thereof.

The Carriage Propulsion System

The portable sawmill 10 also includes a mechanism for propelling the carriage 24 along the track assembly 22. This longitudinal drive mechanism includes a propulsion system employing a power take-off assembly located on the carriage 24. Specifically, and with reference to FIGS. 8 and 9, the power take-off includes a vertically oriented follower wheel 146 which rides in contact with the backside of the lowermost of the upper V-drive belts 140. The follower wheel 146 is carried on a shaft mounted on a bracket 148 which is welded to the rectangular frame 126. Opposite the bracket 148 there is a flexible coupling 150 coaxially mounted with the follower wheel 146 and joined to a steel shaft 152 of hexagonal cross section. The shaft 152 is mounted by means of ball bearing races in a pivoting frame 154. The frame 154 is formed by a pair of longitudinally oriented steel plates 156 forming arms which extend in a fore and aft direction and which are spaced from each other by steel spacing rods 158. The frame 154 pivots about a transverse axle 160 located at the rear of pivoting frame 154 and supported by a bracket assembly 162 which is welded to the frame 122. The bracket assembly 162 has upstanding ears 164 at its rearmost extremity. The ears 164 embrace the rear ends of the arms 156 and provide a mounting support for the axle 160.

A rubber tired wheel 166 is mounted on the hexagonal shaft 152 and is free to move in transverse reciprocation therealong. A fork 168 has a hub 170 which is transversely reciprocal along the axle 160 and fingers 172 which extend forward to capture the rubber tired wheel 166. The rubber tired wheel 166 is rotatable within the confines of the fingers 172, and the position of the fork 168 on the axle 160 is used to control the position of the rubber tired wheel 166 along the hexagonal shaft 152.

At the rear of the hub 170 there is a vertical channel defined by a pair of flanges 174 which are separated by a gap therebetween. The channel defined between the vertically separated flanges 174 receives a finger 176 which is turned longitudinally forward from an upstanding shifting arm 178. The shifting arm 178, best viewed in FIGS. 8 and 9, is rigidly secured to a steel longitudinal control rod 180 which is mounted by means of brackets to the parallel, triangular shaped frames 120 and 122 of the carriage 24.

A transversely oriented, pie-shaped, longitudinal drive control plate 182, best depicted in FIGS. 5, 6 and 11, is welded to the forward end of the rod 180.

Mechanism for Adjustment of Maximum Speed During Vertical Cutting

The longitudinal drive control plate 182 has two arcuate slots 184 and 186 centered about the axis of rotation of the longitudinal control rod 180 at a spaced distance therefrom. There are releasable thumbscrews 188 and 190 disposed in the slots 184 and 186, respectively. The thumbscrew 188 has a shank with a spacing bushing thereon on the front side of the drive control plate 182 and is threadably engaged in a tapped bore or nut in a vertical cutting speed control bar 192 which is located on the back side of the drive control plate 182, and which is best depicted in FIG. 11. The vertical cutting speed control bar 192 has a rearwardly projecting indexing tab 194 which is engageable in a notch in a vertical cutting latch 196, best visible in FIG. 5. The vertical cutting speed control bar 192 is freely rotatable about the control rod 180 and can be moved to any angular disposition relative to the longitudinal drive control plate 182 within the limits of the arcuate slot 184.

The vertical cutting latch 196 has a downwardly depending spacing bar 198 which is biased toward the frame 120 by a small coil spring 200, as depicted in FIG. 5. The latch 196 is rotatably mounted about an upright supporting strut 202 which is welded to the frame 120. The spring 200 tends to pull the latch 196 downwardly, but movement is limited by the spacing bar 198. When the longitudinal drive control plate 182 is rotated by the portable sawmill operator counterclockwise to the position indicated at 182' in FIG. 5 subsequent to the termination of a horizontal cut, the indexing tab 194 will cam the end of the latch 196 upwardly against the bias of the spring 200 until the indexing tab 194 is engaged by the notch 195.

The extent to which the control plate 182 must be rotated before the notch 195 engages the indexing tab 194 is determined by the position at which the vertical cutting speed control bar 192 is clamped by the thumbscrew 188 relative to the control plate 182. The orientation of the vertical cutting speed control bar 192 relative to the control plate 182 determines the maximum speed at which the carriage 24 will longitudinally progress along the track assembly 22 with the saw blade 26 in the vertical position of FIG. 5.

More specifically, the position at which the vertical cutting speed bar 192 is clamped to the backside of the control plate 182 determines the degree of angular rotation of the drive control plate 182, and hence the control rod 180, from the position occupied during a horizontal cut, indicated in solid lines in FIG. 5, to the position occupied during a vertical cut and indicated 182' in FIG. 5. If the thumbscrew 188 is secured near the bottom of the arcuate slot 184, the control rod will be rotated through a greater angle of rotation in order to latch the indexing tab 194 in the notch 195. A greater rotation of the control rod 180 will result in movement of the finger 176 far to the right, as viewed in FIG. 9. The extent to which the finger 176 is moved to the right is increased with an increased angular rotation of the control rod 180. Conversely, if the thumbscrew 188 is clamped near the top of the slot 184 in the control plate 182, the indexing tab 194 will be engaged in the notch 195 in the latch 196 after rotation of the control plate 182 through only a relatively short arc. Under such conditions, the finger 176 will move the fork 168 and the rubber tired wheel 166 relatively close to the axis of rotation of the horizontally disposed, disk shaped metal driven plate 204, visible in FIGS. 6, 8 and 9.

Speed Reduction for the Carriage Drive Mechanism

The metal driven plate 204 is mounted for rotation within a bearing 208 secured relative to the frame 122, as best depicted in FIG. 6. A small, toothed pulley is keyed to the axle to which the driven metal plate 204 is secured. This pulley is engaged with a toothed, rubber belt 210 which extends forwardly and which engages a larger pulley 212. The pulley 212 is secured to a vertical shaft which is carried in a bearing mounting 214 that is also secured to the frame 122. Another small toothed pulley 216 is secured to rotate with the axle which carries the pulley 212 and which rotates within the bearing mount 214. The pulley 216 is engaged with another toothed, rubber belt 218, and extends forwardly and is engaged with a larger toothed pulley 220. The pulley 220 is secured in rotation on a vertical shaft which rotates within a bearing mount 222 that is carried on a mounting bracket 224 that extends rearwardly from the frame 120. A capstan 226 is mounted for rotation in a horizontal plane upon the same axle as is the pulley 220. A rope 228 is wrapped twice about the capstan 226, to ensure frictional engagement therewith, and extends to both ends of the longitudinal track assembly 22. Rotation of the capstan 226 in one direction will cause the capstan 226 to move longitudinally in translation, winding the rope 228 towards one end of the track assembly 22, and playing out rope toward the opposite end of the track assembly 22.

Mechanism for Adjustment of Maximum Speed During Horizontal Cutting

The control plate 182 also includes an arcuate horizontal speed adjustment slot 186. The position of the thumbscrew 190 in the slot 186 determines the maximum speed with which the carriage 24 will be carried relative to the longitudinal guide rope 228 by the capstan 226. A horizontal speed control bar 230 is located on the back side of the control plate 182, as best depicted in FIG. 11. One end of the horizontal speed control bar 230 can be clamped at any location within the slot 186 by means of the thumbscrew 190. The opposite end of the horizontal speed control bar 230 is freely rotatable upon the control rod 180. With the thumbscrew 190 tightened to clamp the horizontal speed control bar 230 in fixed disposition relative to the control plate 182, the control plate 182 is biased toward the position depicted in solid lines in FIG. 5 by a coil spring 232, visible in FIG. 11. One end of the coil spring 232 is hooked about a stud 234 which passes through the horizontal control bar 230 and bears against the back side of the speed control adjustment plate 182 to space the horizontal speed control bar 230 from the control plate 182 so as to prevent the horizontal speed control bar 230 from clamping the vertical speed control bar 192 against the control plate 182. The other end of the coil spring 232 is hooked about a stud 235 which is secured to the carriage frame 120. An enlarged cylindrical horizontal limiting stop 236 projects from the frame 120 forwardly toward the speed control adjustment plate 182 coaxially with the stud 234.

When the vertical indexing tab 194 is released from the notch 195 in the latch 196, the spring 232 will pull the control plate 182 downwardly until the edge of the horizontal speed control bar 230 bears against the horizontal limiting stop 236. The rotational movement of the speed control adjustment plate 182 will be greater if the thumbscrew 190 clamps the horizontal control bar 230 near the upper end of the slot 186 than if the horizontal speed control bar 230 is clamped against the back side of the control plate 182 near the bottom of the slot 186. Since the longitudinal control rod 180 is welded to the control plate 182, the extent of rotational movement of the lever arm 178, best depicted in FIGS. 8 and 9, is controlled by the position of the thumbscrew 190 in the slot 186 during horizontal cutting operations.

If the thumbscrew 190 clamps the horizontal control bar 230 to the control plate 182 near the upper end of the slot 186, the spring 232 will rotate the speed control adjustment plate 182 clockwise downwardly, as viewed in FIG. 5, through a relatively great arc. This will cause the longitudinal control rod 180 to rotate through a relatively great arc and cause the shifting arm 178 to move the fork assembly 168 far to the left as viewed in FIG. 9. Conversely, if the thumbscrew 190 clamps the horizontal control bar 230 immobile relative to the longitudinal drive control plate 182 near the bottom of the slot 186, the spring 232 can pull the control plate 182 clockwise and downwardly through only a relatively small arc, as viewed in FIG. 5. This will cause a relatively small rotation of the shifting arm 178 to carry the fork assembly 168 only slightly to the left of the center of rotation of the driven metal plate 204.

Operation of the Longitudinal Drive and Blade Orientation Reversing Mechanisms The direction and speed of movement of the carriage 24 relative to the track assembly 22 is controlled in the portable sawmill 10 through the position of the rubber tired friction wheel 166 on the face of the driven metal disk 204. With reference to FIGS. 8 and 9, if the rubber tired wheel 166 is positioned to the right of the axis of rotation of the metal driven disk 204, the capstan 226 will be driven in one direction of rotation. That is, the power take-off wheel 146, acting through the flexible coupling 150, will drive the hexagonal shaft 152 and the rubber tired wheel 166 in a single direction of rotation at all times during operation of the engine 25. When the rubber tired wheel 166 is engaged with the face of the metal driven disk 204, and the rubber tired wheel 166 is located to the right of the axis of rotation of the driven metal disk 204, as viewed in FIGS. 8 and 9, the capstan 226 will be driven in one direction of rotation by the rotating driven metal disk 204 through the speed reduction system provided by the rubber, toothed timing belts 210 and 218 operating through the toothed pulleys. If the rubber tired wheel 166 is engaged with the rotating metal disk 204 near the periphery thereof, the rubber tired wheel 166 will rotate the disk 204 at a relatively slow speed. Conversely, if the rubber tired wheel 166 is frictionally engaged with the surface of the driven metal disk 204 near the center thereof, the disk 204 will be driven through a larger angle of rotation for each revolution of the rubber tired wheel 166. This will cause the capstan 226 to be turned faster.

The axes of rotation of the hexagonal shaft 152 and the driven metal disk 204 intersect at a perpendicular angle. Manual rotation of the longitudinal drive control plate 182 to the position depicted at 182' at FIG. 5 will carry the rubber tired wheel 166 to the right of the axis of rotation of the driven metal disk 204, as viewed in FIGS. 8 and 9. The radial displacement of the rubber tired wheel 166 from the axis of rotation of the driven metal disk 204 is determined by the location within the slot 184 at which the thumbscrew 188 is tightened.

A disk shaped cam follower wheel 238, best depicted in FIG. 6, is mounted upon a rearwardly extending bell crank arm 240. The lever arm 240 is locked in rotation relative to the carriage frame with a transverse latch tripping axle 242, best visible in FIGS. 6, 7 and 8. The latch tripping axle 242 is rotatably mounted within bearings from mounting brackets secured to the frame 126. On the side of the frame 126 opposite the bell crank arm 240 the latch tripping axle 242 is secured to a downwardly extending latch release actuating tang 244, visible in FIGS. 7, 8 and 10. The latch release tang 244 terminates in a fork through which a longitudinally disposed latch pin 246 extends, as best viewed in FIG. 10. A spring 248 is maintained in a compressed condition to bear at one end against a metal washer 250 spaced from a mounting bracket 252 welded to the carriage frame 122 by means of a cylindrical annular socket 254. The opposite end of the spring 248 bears against a cotter pin 256 which extends through the latching pin 246. The spring 248 tends to push the latch release tang 244 into juxtaposition against a vertical retaining strut 258 which is welded to the frame 126. The forwardly extending tip 260 of the latching pin 246 has an upwardly disposed inclined surface which forms a bearing support for a generally wedge shaped latching lug 262 which extends rearwardly from the bearing mount 110 of the saw blade arbor 28.

The Vertical Cutting Latching Mechanism

To initially position the saw blade 26 in the vertical upright position, the operator must rotate the crank arm 264 counterclockwise, as viewed in FIG. 5, when the carriage 24 is at the operator end of the track assembly 22. The crank arm 264 is welded to a U-shaped bracket 266 on the arbor 28. When the crank arm 264 is rotated counterclockwise to the position depicted in FIG. 5, the inclined surface of the wedge shaped latching lug 262 will operate as a camming surface against the tip 260 of the latching pin 246, forcing the latching pin 246 to the right as viewed in FIG. 10 against the bias of the spring 248. Once the saw blade 26 has reached the full vertical upright position, the latching lug 262 will be raised just above the tip 260 of the latching pin 246, and the spring 248 will drive the latching pin 246 to the left as viewed in FIG. 10, thus causing the inclined upper face of the tip 260 of the latching pin 246 to bear against the lower face of the latching lug 262 to hold the saw blade 26 in a vertical position.

In the vertical cutting pass along the log 20, the carriage 24 will move away from the operator at the end 18 of the log 20 with the blade 26 in the vertical position. The follower wheel 238, depicted in FIG. 6, will ride upon the upper rail 107 of the track assembly 22. At the remote end of the track assembly 22 proximate to the end 16 of the log 20 the follower wheel 238 will ride up the cam surface formed by the wedge 109 located on the rail 107 of the track assembly 22. This will rotate the bell crank arm 240 clockwise, as viewed in FIG. 6. The latch tripping axle 242 will thereupon be carried in rotation to rotate the tang 244 counterclockwise, as viewed in FIG. 10. The tang 244 will thereupon act against the cotter pin 256 and compress the spring 248 and concurrently force the latching pin 246 back into the socket 254. The tip 260 of the latching pin 246 will then release the latching lug 262 as the follower wheel 238 rides onto the cam surface formed by the wedge 109 on the track assembly 22. That is, the cam follower 238 is forced upwardly, transverse to the longitudinal disposition of the track assembly 22 so that when the latching lug 262 is released, the arbor 28, carrying the saw blade 26, will rotate downwardly under the force of gravity. The saw blade 26 will move from the position depicted in solid lines in FIGS. 5 and 8 to the position indicated at 26′ in those drawing figures.

As the arbor 28 rotates clockwise, as viewed in FIG. 5, to move the saw blade from the vertical position to the horizontal position, a flange 268, which is welded to and extends to the left of the U-shaped bracket 266 also as depicted in FIG. 5, is also moved in clockwise rotation. A control plate tripping wire 270 is secured at one end to the flange 268 and passes through an aperture near the end of the spacing bar 198 that extends vertically downwardly from the latch 196. A hook 272 at the end of the latching wire 270 engages the spacing bar 198 during the last few degrees of rotational movement of the arbor 28 to pull against the spacing bar 198 and overcome the bias of the spring 200. This lifts the latch 196, thereby releasing the vertical indexing tab 194. The control plate 182 will then be pulled in rotation by the spring 232 from the position indicated at 182′ at FIG. 5 to the position indicated in solid lines in that drawing figure. This carries the fork 168 from the right to the left, as viewed in FIGS. 8 and 9, thereby carrying the rubber tired wheel 166 across the axis of rotation of the metal driven disk 204. Since the rubber tired wheel 166 continues to rotate in the same direction, due to the power supplied by the follower wheel 146, the driven metal disk 204 will then be driven in the opposite direction of rotation. This reverses the direction of rotation of the capstan 226, and causes the carriage 24 to reverse its direction of longitudinal movement. That is, the carriage 24 will return from the remote end of the track assembly 22 proximate the end 16 of the log 20 toward the end adjacent the end 18 thereof, when the rubber tired wheel 166 is frictionally engaged to rotate the disk 204.

The Horizontal Cutting Latching Mechanism

When the arbor 28 falls to bring the saw blade 26 to the horizontal position, depicted at 26′ in FIG. 5, a horizontal latching lug 274, depicted in FIG. 10, is brought into latching engagement with a horizontal latching pin 276. The horizontal latching pin 276 is mounted for reciprocal movement through longitudinally aligned apertures in transversely oriented, vertically disposed mounting brackets 278 and 280, best depicted in FIG. 10. As the arbor 28 falls, the wedge shaped horizontal latching lug 274 acts against the inclined face 282 of the tip of the horizontal latching pin 276 to force it forward, overcoming the bias of the compressed coil spring 284. When the saw blade 26 reaches the horizontal cutting position depicted at 26′ in FIG. 5, the spring 284 forces the latching pin 276 rearward to lock the horizontal latching lug 274 in position by means of the bearing surface 282 on the tip of the latching pin 276 which is juxtaposed against the bearing surface 283 on the horizontal latching lug 274. The latching engagement is similar to that of the tip 260 of the vertical latching pin 246 and the vertical latching lug 262.

Once the control plate 182 is in the position indicated in solid lines in FIG. 5, the carriage 24 will move forward from the remote end of the track assembly 22 proximate to the end 16 of the log 20 toward the operator end thereof proximate to the end 18 of the log 20. When the carriage 24 moves forward beyond the front end 18 of the log 20, thereby completing a horizontal cut, the operator draws the horizontal latching pin 276 forwardly by means of the L-shaped handle 286. The handle 286 is connected to the horizontal latching pin 276 and also passes through a guiding aperture in the triangular shaped mounting bracket 280. This releases the horizontal latching lug 274 and allows the operator to raise the arbor 28 to return the saw blade 26 to the vertical position by rotating the lever 264 in a counterclockwise direction, as viewed in FIG. 5. The operator must then also move the control plate 182 from the position to which it drops for horizontal cutting, indicated in solid lines in FIG. 5, to the position indicated in dashed lines at 182′. The longitudinal drive control plate 182 is rotated counterclockwise for this purpose until the lug 194 is engaged in the notch 195 in the latch 196. Rotating the drive control plate 182 in this manner carries the rubber tired wheel 166 from the left side of the metal driven plate 204 to a location to the right of the axis of rotation of the driven metal plate 204, as viewed in FIGS. 8 and 9.

As previously explained, the positions of the thumbscrews 188 and 190 in the arcuate slots 184 and 186, respectively, control the speed of longitudinal movement of the carriage 24 while the blade 26 is in the vertical and horizontal cutting positions.

Support of the Carriage on the Track Assembly

The carriage 24 travels longitudinally and is supported vertically and horizontally by angle shaped rails 105 and 107, depicted in FIGS. 1, 2, 5 and 8. The carriage 24 is supported vertically by V-groove rollers 292 and 294, best depicted in FIGS. 5 and 8. The V-groove rollers 292 and 294 are supported by means of short, longitudinal brackets extending outwardly from the triangular shaped mounting plates 280 and 296 at the front and rear of the carriage 24, respectively. The V-groove rollers 292 and 294 have central, V-shaped grooves formed therein at a 90 degree angle. The V-groove rollers 292 and 294 ride upon the crest of the rail 105 throughout the length of the track assembly 22.

Flat rollers 298 and 300 are also rotatably mounted on longitudinal brackets from the mounting plates 280 and 296 to bear against the underside of one leg of the angle shaped rail 105. The flat rollers 298 and 300 aid in stabilizing the carriage 24. The carriage 24 is also horizontally stabilized by the V-groove rollers 302 and 304 which are rotatably mounted from brackets welded to the frames 120 and 122 at the front and rear of the carriage 24, respectively, as best depicted in FIGS. 5 and 8. The V-groove rollers 302 and 304 likewise define a 90 degree groove which bears against the lateral edge of the rail 107.

Control of Carriage Movement by the Operator

As previously explained, power is supplied from the engine 26 through the follower wheel 146 so that the carriage 24 pulls itself lengthwise along the track assembly 22. Power is supplied through the capstan 226 which winds and unwinds itself along the longitudinal rope 228, drawing the carriage 24 with it. The rope 228 is maintained in tension and is fastened to the track assembly 22 at both ends thereof. However, the capstan 226 is normally disengaged, and will not rotate unless engaged by an operator through a control cable.

The control cable 306 is visible in FIG. 1 and partially visible in FIG. 6. The control cable 306 is firmly secured to the end of the track assembly 22 remote from the operator and proximate to the end 16 of the log 20. The control cable 306 extends the length of the track assembly 22 not within the confines of the triangular shaped truss work but just below v-groove rollers 302 and 304 and is attached at the operator end to a tang 307 on an L-shaped control lever 30.

The L-shaped control lever 30 is rotatably mounted relative to the track assembly 22. When the operator twists the L-shaped control lever 30 by pulling the handle thereon, the tang 307 on the control lever 30 exerts tension on the control cable 306. The control cable 306 passes from the remote end of the track assembly 22 forwardly around a turning pulley 310, visible in FIG. 6, which is rotatably secured to a mounting bracket welded to the underside of the frame 126. From the pulley 310 the control cable passes upwardly and rearwardly around a control pulley 312 which is rotatably secured to the pivoting frame 154. From the control pulley 312 the control cable 306 then passes downwardly and forwardly, again around the turning pulley 310, and longitudinally forward the remaining length of the track assembly 22 to the tang 307.

The pivoting frame 154 is spring biased upwardly by a compressed spring 314, visible in FIGS. 6 and 12. A spacing rod 316 is threaded at its upper end and is threadably engaged in a nut 318 which is welded to the pivoting frame 154. The lower end of the threaded rod 316 extends downwardly within the confines of the coil spring 314, but is normally spaced from the frame 126 a short distance, except when tension is exerted on the control cable 306. The normal separation of the lower end of the rod 316 from the frame 126 is between about one sixteenth and one quarter of an inch. The spacing can be adjusted by the extent of engagement of the rod 316 in the nut 318 so as to adjust the force which the rubber tired wheel 166 exerts on the driven metal disk 204 when tension is exerted on the control cable 306. A detail of the adjustment rod 316 appears in FIG. 12.

The force of the compressed spring 314 normally biases the pivoting frame 154 counterclockwise, as viewed in FIG. 6, to maintain the rubber tired wheel 166 out of driving engagement with the driven metal disk 204. However, when tension is exerted on the control cable 306, the control pulley 312 is drawn downwardly, rotating the pivoting frame 154 slightly in a clockwise direction against the bias of the compressed spring 314, as viewed in FIG. 6. This small clockwise rotational movement brings the driving wheel 166 into driving engagement with the driven metal plate 204. When driven by the rubber tired wheel 166, the driven metal plate 204 turns the pulleys connected through the toothed timing belts 210 and 218 to rotate the capstan 226. As long as the operator maintains tension on the control cable 306, the carriage 24 will progress longitudinally along the track assembly 22 in the direction determined by the position of the fork 168 relative to the driven metal wheel 204.

Summary of Operation of the Invention

The sawing operation is commenced with the carriage 24 initially at the remote end of the track assembly 22, proximate to the end 16 of the log 20. The saw blade 26 is initially in the horizontal position and the speed control adjustment plate 182 is initially moved to the position indicated at 182 in FIG. 5. The horizontal and vertical cutting depths of the saw blade 26 are adjusted through the horizontal and vertical adjustment mechanisms 38 and 70 in the manner previously described. Once the saw blade 26 has been positioned to achieve the desired horizontal depth of cut in progressing toward the operator end of the track assembly 22, and the subsequent desired depth of vertical cut in the return pass, the operator twists the control lever 30. Tension is exerted on the control cable 306 and the carriage 24 is propelled longitudinally along the track assembly 22 by means of the capstan 226. The saw blade 26 effectuates a first initial horizontal cut lengthwise along the log 20. When it clears the operator end 18 the operator releases the operating lever 30 to stop the carriage 24. The operator then raises the blade 26 to the vertical position using the crank arm 264. The operator also raises the drive control plate 182 to the position indicated at 182' in FIG. 5.

The operator then pulls on the operating lever 30. With the drive control plate 182 in the position of 182', the carriage 24 moves away from the operator toward the remote end 16 while the blade 26 performs a vertical cut.

Once the carriage 24 has passed the end 16 of the log 20, the cam follower 238 rides upon an inclined cam surface formed by the wedge 109 on the rail 107 in the manner previously described. The clockwise rotation of the bell crank arm 240, as viewed in FIG. 6, rotates the transverse shaft 242. The tang 244 thereupon releases the vertical latching pin 246, and the arbor 28 and saw blade 26 fall from the vertical position indicated at 26 in FIG. 5 to the horizontal position indicated at 26' in that drawing figure.

When the cam follower 238 rides up the inclined surface of the wedge 109 and the bell crank arm 240 is rotated clockwise, the engine throttle control arm 320, visible in FIG. 6, is also rotated clockwise. The engine throttle control arm 320 is coupled to the throttle of the engine 25 by a conventional coupling mechanism. Clockwise rotation of the throttle control arm 320 throttles down the speed of the engine 25 to an idling speed. The throttle control arm 320 is normally spring biased in a counterclockwise direction, as viewed in FIG. 6. In this way the engine throttle control arm 320 is coupled to the engine 25 and to the cam follower 238 so that the cam follower 238 actuates the throttle control arm 320 to throttle down the engine 25 concurrently with release of the vertical latching pin 246.

As the arbor 28 drops under the force of gravity, carrying the saw blade 26 to the horizontal cutting position, the control plate tripping wire 270 rotates the latch 196 in a counterclockwise direction, as viewed in FIG. 5. The indexing tab 194 on the back side of the control plate 182 is thereupon released so that the spring 232, visible in FIG. 11, rotates the control plate 182 clockwise, as viewed in FIG. 5, thereby drawing the fork 168 from the right of center of the axis of rotation of the driven metal plate 204 to the left of center of the axis of rotation thereof, as viewed in FIGS. 8 and 9.

The cut piece of lumber is then removed, and the vertical and horizontal adjustment mechanisms 70 and 38, respectively, are then again adjusted for the next sequential horizontal and vertical cuts during the next pass and return of the carriage 24 along the track assembly 22. Adjustment of the mechanisms 38 and 70 is performed so as to cut lumber having cross sectional dimensions as desired.

An elbow shaped blower pipe 322, visible in FIG. 1, is connected to a saw blade guard 324, visible in FIGS. 1 and 5. As sawdust is thrown up by the saw blade 26 into the blade guard 324, it is diverted and thrown away from the log 20. This prevents the sawdust buildup below the track assembly 22 which could otherwise impede the movement of the carriage 24.

A stabilizing wheel 326 is secured by an upright leg 328 to the back edge of the blade guard 324 in a vertically adjustable fashion, as best illustrated in FIG. 6. The roller 326 is thereby releasably secured to the carriage 24 and is adapted to ride upon an exposed, horizontally cut surface of the log 20. The roller 326 is not employed in the initial cuts, and a thumbscrew which releasably holds the leg 328 at a selected vertical elevation is loosened and the leg 328 is raised to move the roller 326 out of the way during the initial cuts. The roller 326 is only employed when the first horizontal surface of lumber to be cut to dimension has once been established. The roller 326 enhances the stability of the carriage 24, thereby holding the dimensions of the cut lumber more closely to specification.

A damping mechanism in the form of an air cylinder 329 is interposed between the arbor 28 and the frame of the carriage 24. The purpose of the air cylinder 329 is to limit the speed of descent of the saw blade 26 from the vertical disposition indicated at 26 in FIG. 5 to the horizontal disposition indicated at 26' in that same drawing figure. The air cylinder 329 is connected at one end to the arbor 28 through the blade guard 324. The opposite end of the air cylinder 328 is connected to a crank arm 330 which pivots on the longitudinal control rod 180. When the arbor 28 is released, the rate at which the piston is pushed into the air cylinder 329 is dampened, thereby slowing the rate at which the arbor 28, blade guard 324 and saw blade 26 drop under the force of gravity to orientation for a horizontal cut.

Adjusting mechanisms are provided for ensuring precision in the horizontal and vertical orientation of the saw blade 26. Specifically, and as viewed in FIG. 7, a pair of horizontal adjusting screws 332 are located in spaced separation from each other along the top of the longitudinal tube 128. The adjustment screws 332 are disposed along horizontal axes perpendicular to the direction of carriage movement. The heads of the adjustment screws 332 protrude to the right of the tube 128, as viewed in FIG. 7, a distance determined by their threaded engagement with adjusting nuts 334, which are welded to sockets 336 residing atop the tube 128. The heads of the adjusting screws 332 will bear against the arbor 28 when the blade 26 has fallen to the horizontal cutting position 26'. Fine adjustments can be performed so that the blade 26 effectuates precise horizontal cuts by means of the adjustment screws 332.

Similarly, a vertical adjustment screw 338, depicted in FIG. 10, is disposed along a vertical axis and is threadably engaged in a nut 340 which is welded to a socket 342, which in turn depends from and is welded to the underside of the frame 128. The head of the adjustment screw 338 bears against the arbor 28 when the arbor 28 carries the saw blade 26 in the vertical cutting position. Small changes in the degree of threaded engagement of the shank of the adjustment screw 338 with the nut 340 can be performed to ensure precise vertical cutting by the saw blade 26.

The embodiment of the portable sawmill 10 depicted in FIGS. 1–12 is the preferred embodiment of the invention as presently contemplated. However, numerous alternative embodiments of the invention are possible within the scope of the invention. For example, carriages of different configuration can be employed. One alternative form of a carriage according to the invention is depicted at 346 in FIGS. 13–16. The carriage 346 includes many of the same features as the carriage 24. Corresponding parts of the carriages bear like reference numbers. There are certain differences in the construction and positioning of the carriage parts, however.

An Alternative Carriage Embodiment

Figure 13:
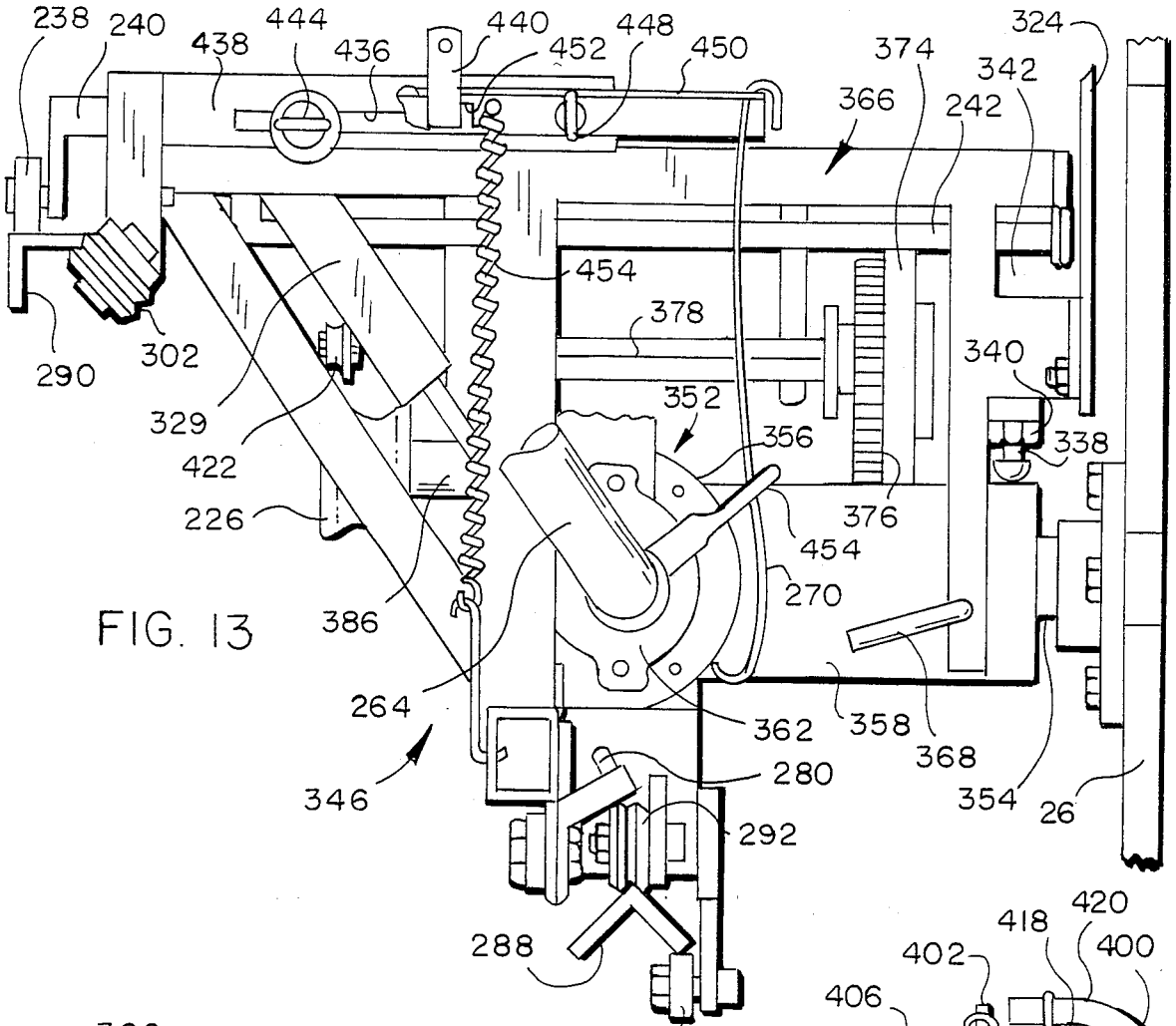
FIG. 13 is a front elevational view of an alternative embodiment of a carriage for a portable sawmill according to the invention.
Figure 14:
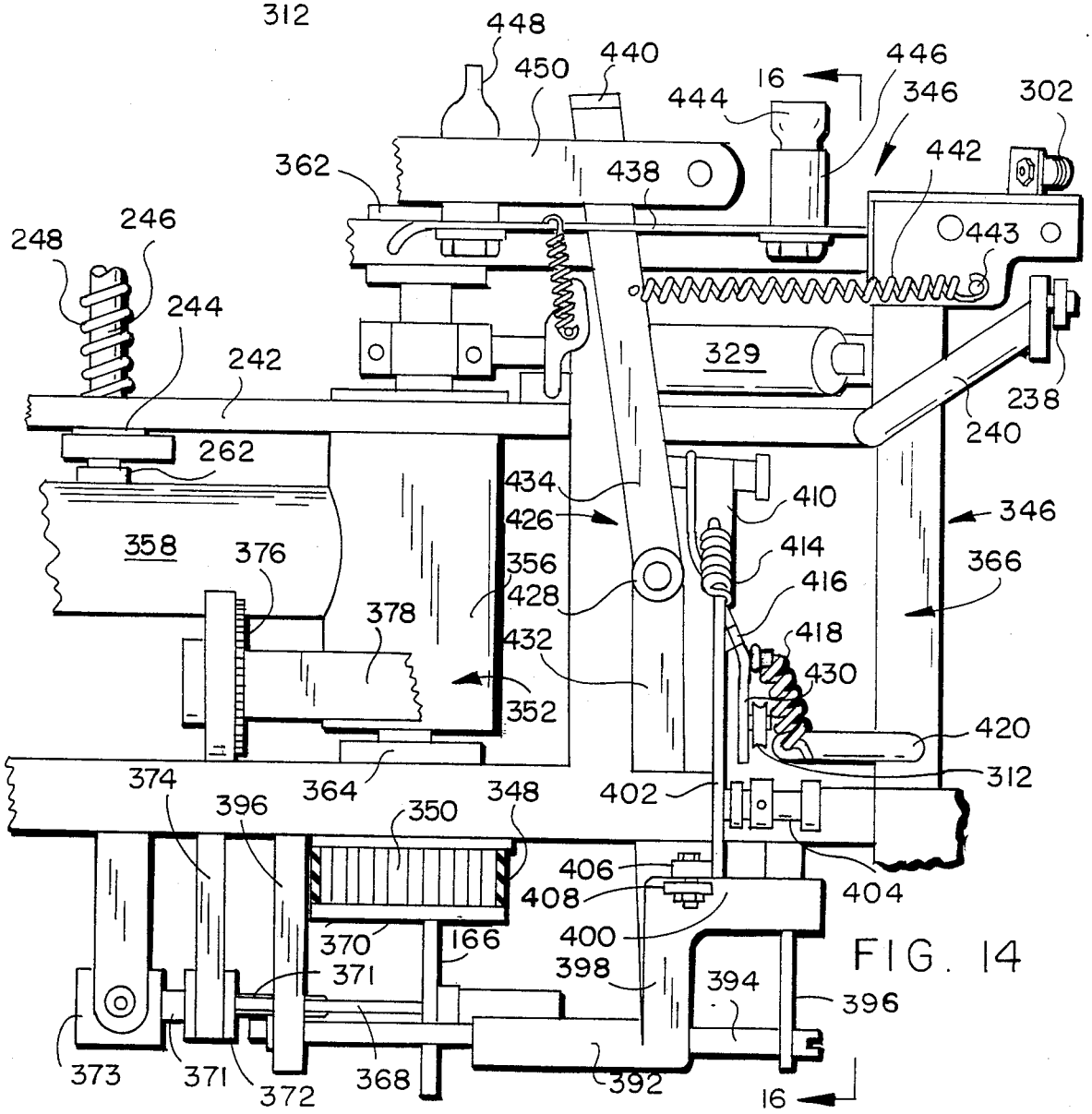
FIG. 14 is a top plan view of a portion of the carriage of the embodiment of FIG. 13 corresponding to the view of FIG. 9.

One significant difference between the carriage 346 and the carriage 24 is that the engine 25 drives the saw blade 26 in the carriage 24 through a belt and pulley system. In the carriage 346, on the other hand, the engine has a longitudinally rearwardly extending, horizontally disposed output drive shaft which drives a toothed timing belt 348, visible in FIG. 15. The timing belt 348 steps down the speed of the engine drive shaft and is engaged with a driving drum 350. The driving drum 350 is coupled by a longitudinal input shaft to a speed reduction gear transmission system encased in a gear housing 352, shaped generally in the form of perpendicularly intersecting cylinders, as best illustrated in FIGS. 13 and 14. The input shaft from the driving drum 350 extends axially into the longitudinally oriented cylinder 356. The gear housing 352 contains conventional speed reduction gearing to rotate a saw blade output drive shaft 354, visible in FIG. 13. The saw blade drive shaft 354 extends axially out of a transversely oriented cylinder 358. The gear system housing components 356 and 358 together form an arbor which is rotatably mounted about a longitudinal axis within bearings 362 and 364 which are secured to the frame 366 of the carriage 346. The output drive shaft 354 extends perpendicular to the direction of longitudinal movement of the carriage 346.

The housing for the speed reduction gear system 352 is shaped generally in the form of two cylinders 356 and 358 which intersect each other at right angles.

As with the arbor 28, the arbor formed by the gear housing 352 is mounted upon the carriage 346 to carry the saw blade 26 alternatively at mutually perpendicular angles of orientation relative to the carriage 346. To set the saw blade 26 for vertical cutting, in the position of FIG. 13, the lever 264 is rotated counterclockwise to the position depicted in FIG. 13. The lever 264 is rigidly coupled to the gear housing 352.

When the saw blade 26 is in the vertical cutting position depicted in FIG. 13, it is held in the vertical latched position by a vertical latching pin 246, visible in FIG. 14, of the type described in the embodiment of FIGS. 5–12. A lever 368, visible in FIG. 13, passes through an aperture in the frame 366 and is coupled to the vertical latching pin 246 which resides in longitudinal alignment with the direction of carriage movement.

The vertical latching pin 246 is released through an actuating mechanism partially visible in FIG. 14. The actuating mechanism includes a fork 244 welded to a transverse actuating rod 242 that extends across the width of the carriage frame 366. The transverse actuating rod 242 is mounted for rotation about its axis in mountings on the frame 366.

A cam follower 238 is carried on a bell crank arm 240 which extends slightly forwardly toward the front of the carriage 346. The cam follower 238 interacts with a cam surface on the top of the rail 107 in the manner previously described in connection with the embodiment of FIGS. 5–12 to release the vertical latching pin 246 when the carriage has completed the pass from the operator end of the track assembly 22 to the end remote therefrom. The primary difference in construction of the vertical latching mechanism and the means for disengagement thereof in the embodiment of FIGS. 13–16 from that of FIGS. 5–12 is that both the vertical latching pin 246 and the bell crank arm 240 are located forwardly of the saw blade drive shaft 354, relative to the frame 366, rather than to the rear thereof. When the vertical latching pin 246 is pushed forward out of disengagement with the vertical latching lug 262, the arbor formed by the gear housing 352 will rotate under the force of gravity so that the cylinder 358 drops from a horizontal to a vertical orientation, thereby carrying the saw blade 26 from a vertical to a horizontal orientation. A horizontal latching mechanism constructed in a manner quite similar to that depicted in association with the carriage embodiment of FIGS. 5–12 is employed to hold the saw blade 26 in a horizontal latching position. The horizontal latching pin is manually released by the operator when the carriage 346 has returned to the operator end of the track assembly 22 by means of the draw bar 280, a portion of which is visible in FIG. 13.

The power take-off and the control mechanism for controlling the longitudinal movement of the carriage 346 differ structurally from that of the carriage embodiments of FIGS. 5–12, but operate upon essentially the same principles. Specifically, a rubber tired wheel 166 is secured upon the end of the flexible, transverse shaft 368, as best viewed in FIGS. 14 and 15. A driving metal disk 370 is vertically oriented and is mounted coaxially with the driving drum 350. In addition to driving the saw blade drive shaft 354, the drum 350 also carries with it the driving metal disk 370 which rotates about a longitudinal axis parallel to the direction of carriage movement.

A power take-off for controlling the direction and speed of longitudinal movement of the carriage 346 on the track assembly 22 is provided by the rubber tired wheel 166 when the wheel 166 is frictionally engaged with the rotating metal disk 370. When the rubber tired wheel 166 is driven by the rotating metal disk 370, it turns the flexible shaft 368 which is formed by a tightly wound coil spring. The rubber tired wheel 166 is rigidly joined to the flexible shaft 368, which in turn is joined to a shaft 371 having a hexagonal cross section. A small pulley 372 is keyed to the hexagonal shaft 371, but the hexagonal shaft 371 is free to move in transverse reciprocation through the hub of the pulley 372 and through a bearing mount 373 that is secured to the frame 366. A toothed rubber belt 374, located in a vertically oriented, longitudinal plane, is engaged with and extends forwardly from the small pulley 372 and drives a large sprocket 376, partially visible in FIGS. 15 and 16. The sprocket 376 is located on one side of the gear housing 352 and rotates on a horizontally disposed, transverse shaft 378 rotatably mounted within bearings secured to the carriage frame 366. The opposite end of the shaft upon which the sprocket 376 is mounted extends transversely across the structure of the gear housing 352. A smaller, toothed pulley 380 is secured to the end of the shaft 378 opposite the sprocket 376, and is connected by another toothed belt 382 to another large sprocket 384. The sprocket 384 is carried on a transverse shaft 386 which extends to the left, as viewed in FIG. 14. The transverse shaft 386 carries the capstan 226. As in the carriage embodiment of FIGS. 5–12, the longitudinal guide rope 228 is wrapped twice about the capstan 226.

Figure 15:
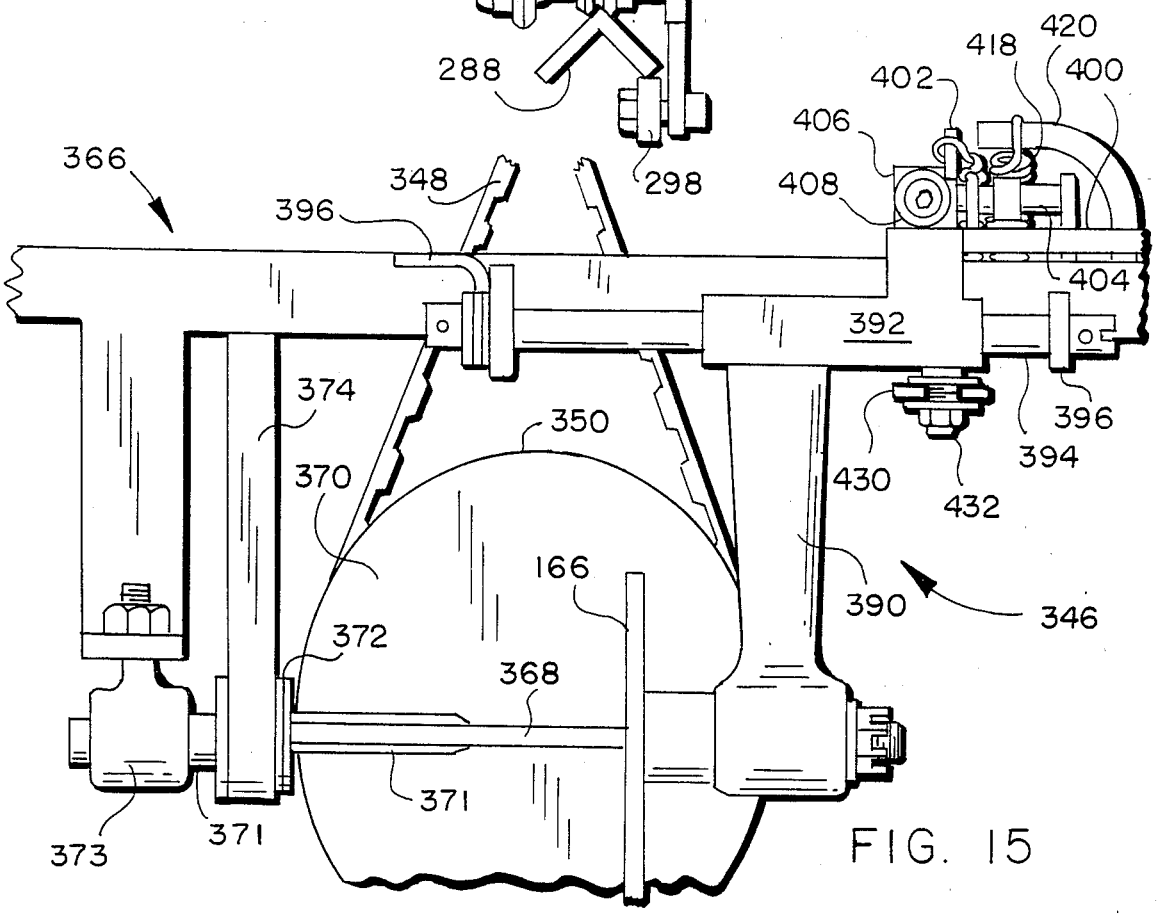
FIG. 15 is a rear elevational view of a portion of the carriage of FIGS. 13-14.
Figure 16:
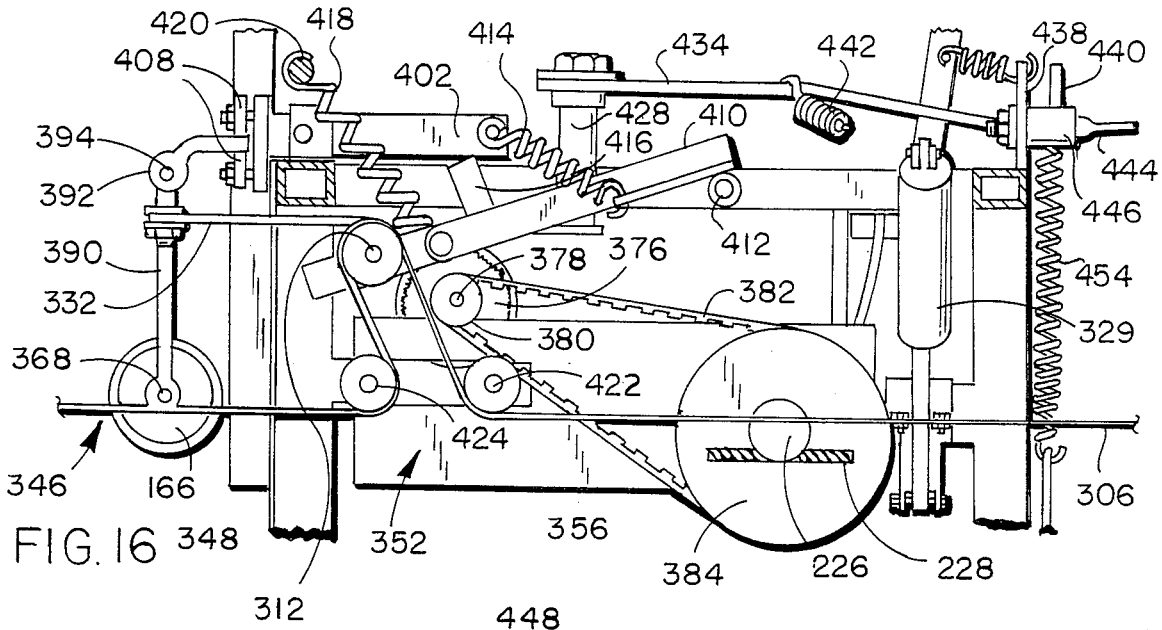
FIG. 16 is a left side elevational view of a portion of the carriage of FIGS. 13-15.

The rubber tired wheel 166 is carried on a generally vertically oriented bell crank arm 390, as best viewed in FIGS. 15 and 16. The bell crank arm 390 is joined to a sleeve 392 which is reciprocally moveable along a transverse axle rod 394. The axle rod 394 is mounted on brackets 396 which extend rearwardly from the carriage frame 366. From the hub 392 a lever arm 398 extends forwardly and terminates in a transverse track plate 400, best depicted in FIGS. 14 and 15.

A longitudinally oriented rocker arm 402 is pivotally mounted on the end of a transverse axle 404 which is carried in a pair of brackets disposed atop the frame 366. The rear end of the rocker arm 402 terminates in a transverse plate 406 which carries a pair of rollers 408 on longitudinal axes in vertically spaced separation from each other above and below the track 400. When the rubber tired wheel 166 is moved transversely relative to the direction of carriage movement, it carries with it the track 400, which moves transversely between the rollers 408.

The control pulley 312 is rotatably connected to the rear end of a longitudinally oriented, downwardly inclined crank arm 410. The crank arm 410 is rotatably mounted relative to the frame 366 by means of a transversely projecting stub axle 412. One end of a coil spring 414 is connected to the mid-portion of the crank arm 410, and the opposite end of the spring 414 is connected to the forward extremity of the rocker arm 402. The coil spring 414 is in tension and tends to draw the forward end of the rocker arm 402 downwardly so that the rollers 408 force the track 400 upwardly and in counterclockwise rotation, as viewed in FIG. 16. The bell crank arm 390 will thereupon force the rubber tired wheel 166 into frictional engagement with the rotating metal disk 370. The flexible construction of the axle 368 permits the slight rotational movement involved.

However, the force of the spring 414 is normally opposed by the force of another coil spring 418, best depicted in FIGS. 14 and 16, which is secured at one end to an upstanding, transversely oriented support bar 420 on the frame 366, and at the opposite end to the crank arm 410 near the control pulley 312. The spacing bar 416 bears against the rocker arm 402 and limits the extent to which the crank arm 410 is pulled toward the rocker arm 402.

The tensional force on the spring 418 is transmitted to the forward end of the rocker arm 402 by means of the spacing bar 416 to overcome the force of the spring 414 and urge the rocker arm 402 counterclockwise, as viewed in FIG. 16. This forces the track 400 and crank arm 398 downwardly and in clockwise rotation, as viewed in FIG. 16, and rotates the bell crank arm 390 clockwise so that the rubber tired wheel 166 is lifted from the surface of the rotating metal disk 370, as depicted in FIG. 16.

The control cable 306 in the embodiment of FIGS. 13–16 passes around a turning pulley 422, over the control pulley 312, and back around another turning pulley 424. As in the carriage embodiment of FIGS. 5–12, the control cable 306 is secured to the structure of the track assembly 22 at one end and to the operator control lever 30 at the opposite end. When the operator presses on the control lever 30 to exert tension on the control cable 306, the tension exerted pulls the control pulley 312 downward, thereby rotating the crank arm 410 in a counterclockwise fashion, as viewed in FIG. 16. The tension on the control cable 306 thereby nullifies the force of the spring 418 so that the tension on the spring 414 is unopposed and causes the rocker arm 402 to rotate clockwise, as viewed in FIG. 16. The lowermost roller 408 thereby presses upwardly on the track 400, rotating the bell crank arm 390 counterclockwise and bringing the rubber tired wheel 166 into frictional engagement with the metal disk 370. As long as the operator pulls on the control handle 30 to maintain tension on the control cable 306, the rubber tired wheel 166 will be driven by the rotating metal disk 370. The flexible axle 368 turns the hexagonal shaft 371, which in turn rotates pulley 372, thereby driving the toothed belts 374 and 382 so as to turn the capstan 226. The capstan 226 will thereby draw the carriage 346 longitudinally along the guide rope 228 in the manner described in connection with the carriage embodiment of FIGS. 5–12.

When the operator releases the handle 30 the control cable 306 is no longer maintained in tension. The spring 418 will thereupon rotate the crank arm 410 clockwise so that the pressure bar 416 forces the forward end of the rocker arm 402 upwardly. The uppermost roller 408 then presses downwardly on the track 400, rotating the bell crank arm 390 in a clockwise direction. The rubber tired wheel 166 is thereby lifted from the driving surface of the rotating metal disk 370 and the pulley 372 ceases to rotate so that rotation of the capstan 226 is halted.

The direction and speed of rotation of the capstan 226 is determined by the position of the rubber tired wheel 166 relative to the rotating metal disk 370. The rubber tired wheel 166 can be moved reciprocally in a transverse direction along an axis which intersects the axis of rotation of the rotating metal disk 370 at a right angle. The rubber tired wheel 166 is moved in transverse reciprocation by means of a bell crank mechanism 426, best depicted in FIG. 14. The bell crank mechanism 426 is mounted for rotation about a vertical axis within a sleeve 428 which is secured to the carriage frame 366. The bell crank mechanism 426 has a rearwardly extending arm 430 which terminates in a fork that is slideably engaged with the shank of a stud 432 projecting vertically downwardly from the underside of the hub 392, visible in FIG. 15. The forward arm 434 of the bell crank mechanism 426 extends through a transverse slot 436 in a vertically disposed, transversely oriented adjustment plate 438, as illustrated in FIGS. 13, 14 and 16. The forward extremity of the forward arm 434 is turned up vertically in an actuating lever 440, and the adjustment plate 438 is welded to the frame 366.

One end of a coil spring 442, visible in FIG. 14, is secured to an upstanding stud 443 on the carriage frame 366. The other end of the spring 442 is attached through an aperture to the forward arm 434 of the bell crank mechanism 426. The spring 442 thereby tends to rotate the bell crank mechanism 426 in a clockwise direction, as viewed in FIG. 14. This tends to force the hub 392 to the left along the axle rod 394, so that the rubber tired wheel 166 is forced toward the extreme left and to the left of center of the rotating metal disk 370, as viewed in FIGS. 14 and 15.

A releasable thumbscrew 444, having a padded rubber sleeve 446 thereon, is adjustably secured in the slot 436 in the adjustment plate 438. That is, the thumbscrew 444 may be loosened and moved laterally as viewed in either FIG. 13 or FIG. 14. The position of the thumbscrew 444 in the slot 436 determines the speed of longitudinal movement of the carriage 346 along the track assembly 22 when the saw blade 26 is in the horizontal cutting position. When the saw blade 26 is in the horizontal cutting position, the rubber tired wheel 166 will be pulled to the left of the center of rotation of the metal disk 370, as viewed in FIGS. 14 and 15, by the force of the spring 442.

The position of the adjustable thumbscrew 444 in the slot 436 determines the distance from the axis of rotation of the metal disk 370 to which the rubber tired wheel 166 is drawn. If the adjustable thumbscrew 444 is moved to the extreme right hand position, as viewed in FIG. 14, the rubber tired wheel 166 will be pushed to an extreme left hand position relative to the rotating metal disk 370. Since the velocity of a point near the periphery of the rotating metal disk 370 is greater than the velocity of a point near the axis of rotation thereof, movement of the rubber tired wheel 166 to an extreme left hand position, as viewed in FIGS. 14 and 15, will cause the rubber tired wheel 166 to rotate at a relatively great rate of speed, thereby driving the capstan 226 at a relatively high rate of speed. Accordingly, when the adjustable thumbscrew 444 is moved to the extreme right, as viewed in FIG. 14, the carriage 346 will progress longitudinally along the track assembly 22 at a relatively high rate of speed when the operator engages the control line 306 with the control lever 30 during horizontal cuts of the saw blade 26. Conversely, if the thumbscrew adjustment 444 is moved somewhat to the left in FIG. 14 within the slot 436 and retightened against the adjustment plate 438, the speed at which the rubber tired wheel 166 rotates during horizontal cuts will be reduced.

The bell crank mechanism 426 is also used to control the speed of rotation of the capstan 226 during vertical cuts of the saw blade 26. Another adjustable thumbscrew 448 is also positioned in the slot 436 of the adjustment plate 438. The thumbscrew 448 establishes the fulcrum of rotation of a vertical cutting speed control latch 450, which is best depicted in FIG. 13. The vertical cutting speed control latch 450 has a latching arm with a notch 452 defined therein. A coil spring 454 draws the latching arm of the lever 450 downwardly in counterclockwise rotation as viewed in FIG. 13. To commence a vertical cut, the operator rotates the arbor crank arm 264 counterclockwise, as viewed in FIG. 13, to engage the vertical latching pin 246 with the vertical latching lug 262, as previously described. The operator must also manually press the operating lever 440 of the bell crank mechanism 426 to the right, as viewed in FIG. 13. The arm 434 of the bell crank mechanism 426 will slide along the inclined tip of the latching arm of the vertical speed control latch 450, raising it out of the way until the bell crank arm 434 is in registration with the notch 452. The control latch 450 will then hold the bell crank arm 434 toward the left, as illustrated in FIG. 14, against the bias of the spring 442.

With the bell crank arm 434 latched in the notch 452 of the latching arm of the vertical cutting speed control latch 450, the rubber tired wheel 166 will contact the metal plate 370 to the right of the axis of rotation thereof. The direction of rotation of the rubber tired wheel 166 will thereby be reversed from the direction in which it rotates during horizontal cutting.

The speed of rotation of the rubber tired wheel 166 is controlled by the position of the vertical cutting adjustment thumbscrew 448. That is, if the vertical adjustment thumbscrew 448 is moved to the left, as viewed in FIG. 14, the bell crank arm 434 will also be drawn to the left and will contact the rotating metal disk 370 near the right hand periphery thereof, as viewed in FIGS. 14 and 15. The speed of rotation of the capstan 226 will thereby be relatively great, thus causing the carriage 346 to travel longitudinally along the track assembly 22 at a relatively high rate of speed when the operator exerts tension on the control line 306. If the vertical adjustment thumbscrew 448 is fastened at a location more to the right, as viewed in FIG. 14, the rubber tired wheel 166 will be moved to the left and closer to the center of rotation of the rotating metal disk 370. This will cause the rubber tired wheel 166 to rotate at a slower speed, thereby reducing the speed at which the capstan 226 rotates.

FIG. 13 illustrates the position of the arbor crank arm 264 and the directional control lever 440 in position to effectuate a vertical cut by the saw blade 26. Tension on the control cable 306, applied through the control lever 30 will cause the carriage 346 to traverse from the operator end of the track assembly 22, proximate to the end 18 of the log 20 as viewed in FIG. 1, toward the remote end. The saw blade 26 will effectuate a vertical cut in the log 20.

When the carriage 346 reaches the remote end of the track assembly 22, the cam surface of the wedge 109 on the rail 107 will lift the cam follower roller 238, thereby disengaging the vertical latching pin 246 from the vertical latching lug 262 in the manner previously described. The arbor 352 will thereby rotate downwardly in a clockwise direction, as viewed in FIG. 13. The speed of rotation will be dampened by the air cylinder 329 which is connected between the frame 366 and the arbor 352.

As the arbor 352 approaches its lowest position, the lever arm 454, which is rigidly secured to the arbor 352, will pull on the generally vertically oriented trip wire 270. This rotates the vertical speed control latch 450 slightly in a clockwise direction about the fulcrum established by the vertical adjustment thumbscrew 448. Clockwise rotation of the latch 450 raises the latching arm thereof, thereby releasing the bell crank arm 434 from the notch 452. The spring 442 pulls the bell crank arm 434 in a clockwise direction, as viewed in FIG. 14, thereby shifting the rubber tired wheel 166 from a position to the right of the axis of rotation of the metal disk 370 to a position to the left thereof. The direction of rotation of the capstan 226 is thereby reversed so that engagement of the longitudinal drive mechanism by means of the lever 30 will cause the carriage 346 to move from the remote end toward the operator end of the track assembly 22.

In both embodiments of the invention, the portable sawmill can be operated by a single person standing at the operator end of the machine. Before commencing a horizontal cut, the operator adjusts both the horizontal cutting depth control mechanisms 38 and the vertical depth cutting control mechanisms 70 in the manner previously described. These adjustments are performed incrementally so that lumber of precise cross sectional configuration is cut from the log 20. As previously described, the operator can adjust both horizontal depth cutting adjustment mechanisms 38 with the hand wheel 48 from the operator end of the mechanism. Likewise, the operator can adjust both vertical depth cutting mechanisms 70 at the operator end of the mechanism by means of the vertical depth cutting adjustment lever 94.

The carriage which carries the rotating saw blade 26 moves away from the operator position with the saw blade 26 in a vertical plane so as to effectuate a vertical cut along the log 20. When the carriage reaches the remote end of the track assembly 22, the interaction of the cam follower 238 with the cam surface on the top of the rail 107 actuates the direction reversing mechanism employed in the carriage, as previously described. The renewed application of force on the handle 30 will cause the capstan 226 to pull the carriage back to the operator end of the portable lumber milling machine while effectuating a horizontal cut.

Each time the carriage reaches the operator end of the machine, the operator is able to alter separately the maximum speed of the longitudinal drive mechanism for both the next sequential vertical and horizontal cuts. The operator is able to engage and disengage the longitudinal drive mechanism, at will, at any time, by means of the control lever 308, and to vary speed up to the established maximum in continuously adjustable fashion by varying the tension on the control line 306 so as to vary the extent of frictional engagement of the rope 228 with the capstan 226.

After the initial trimming cuts to achieve vertical and horizontal surfaces, dimensioned lumber is cut away from the log 20, piece by piece, with each traverse of the carriage up and back the track mechanism 22. When the top portion of the log 20 has been cut away into lumber, it may become necessary to reposition the bolts 34 in the log 20. Ultimately the support beam 32 will rest upon the ground and the struts 36 will be removed.

The remaining portion of the log 20 will be positioned between the support beams 32.

For smaller logs or log sections, the bolts 34 may not be employed at all and it may be necessary to support the log 20 on transverse supports located within the space between the support beams 32.

Undoubtedly, numerous variations and modifications of the invention will become readily apparent to those familiar with logging and lumber milling operations. Accordingly, the scope of the invention should not be construed as limited to the specific embodiments depicted and described herein, but rather is defined in the claims appended hereto.

We claim:

1. A lumber cutting machine comprising a track supported to extend parallel to a log to be longitudinally cut into lumber, a carriage mounted to move in longitudinally reciprocal fashion upon said track, a power source mounted in fixed orientation upon said carriage, a single rotary saw blade coupled to receive a driving, rotary input from said power source, an arbor carrying said saw blade and mounted for rotation relative to said carriage and relative to said power source about a longitudinal axis to alternatively carry said saw blade in an elevated position in a vertical plane and a lowered position in a horizontal plane, latching means on said carriage for latching said arbor to hold said saw blade in said elevated position, and means for tripping said latching means to release said arbor to allow said arbor to rotate downwardly and said saw blade to fall due to the force of gravity from said elevated position to said lowered position.

2. A portable lumber milling machine comprising:

mounting means designed for securement relative to a transversely cut log to be longitudinally sawn into lumber, a track mechanism attached to said mounting means and extending parallel to the alignment of said log, a carriage which rides upon said track mechanism, an engine mounted in fixed orientation upon said carriage, a saw blade driven by said engine and moveable between an elevated position for rotation in a vertical plane and a lowered position for rotation in a horizontal plane, support means rotatably secured to said carriage and rotatable relative to said carriage and said engine to alternatively carry said saw blade in said elevated position and in said lowered position, latching means for releasably holding said support means to carry said blade in said elevated position, latch release means for tripping said latching means at a predetermined positon along said track mechanism to change the orientation of said saw blade to allow said support means to fall in rotation under the force of gravity and to carry said saw blade from said elevated position to said lowered position, and a longitudinal drive mechanism operable by an operator located at one end of said track mechanism to control movement of said carriage along said track mechanism,

3. A portable lumber milling machine according to claim 2 in which said mounting means includes means for separately adjusting the location of said track mechanism relative to said log both horizontally and vertically relative to the alignment of said log.

4. A portable lumber milling machine according to claim 3 in which said means for adjusting the location of said track mechanism includes a vertical adjustment means operable from one end of said track mechanism for moving said track mechanism vertically while maintaining said track mechanism parallel to said log and a horizontal adjustment means operable from the same end of said track mechanism for moving said track mechanism horizontally while maintaining said track mechanism parallel to said log.

5. A portable lumber milling machine according to claim 2 in which said longitudinal drive mechanism includes a power take-off located on said carriage and carriage propulsion means engageable with said engine, and a control line extending the length of said track mechanism, whereby tension exerted on said control line engages said propulsion means with said engine.

6. A portable lumber milling machine according to claim 5 in which said propulsion means includes speed reduction means and means for adjusting the extent of speed reduction in said speed reduction means.

7. A portable lumber milling machine according to claim 6 in which said means for adjusting the extent of speed reduction is continuously variable.

8. A portable lumber milling machine according to claim 2 in which said track mechanism is comprises of a plurality of track sections releasably secured together.

9. A portable lumber milling machine according to claim 2 further comprising means for reversing the operation of said propulsion means coupled to said blade supporting means, whereby movement of said saw blade between said vertical and horizontal orientations reverses the direction in which power is provided by said propulsion means.

10. A portable lumber milling machine according to claim 2 further comprising a roller releasably secured to said carriage and adapted to ride upon an exposed horizontally cut surface of said log.

11. A portable lumber milling machine according to claim 2 in which said latching means is comprised of a latch interposed between said support means and said carriage, and said latch release means includes a track follower on said carriage disposed to follow said track mechanism, and a cam located upon said track surface, whereby said track follower unlatches said latch as it rides onto said cam and moves transversely relative to said track mechanism.

12. A portable lumber milling machine according to claim 11 further comprising an engine throttle control coupled to said engine and to said track follower, whereby said track follower actuates said throttle control to throttle down said engine concurrently with release of said latching means.

13. A portable lumber milling machine according to claim 11 further comprising damping means interposed between said carriage and said blade support means to limit the speed of movement of said saw blade from a vertical orientation to a horizontal orientation, and further comprising horizontal latching means to latch said saw blade in a horizontal orientation in said lowered position.

14. A portable lumber milling machine according to claim 11 in which said longitudinal drive mechanism includes a propulsion means located on said carriage and engageable with said engine, a control line extending the length of said track mechanism for engaging said propulsion means with said engine, and direction reversing means coupled to said blade supporting means, whereby movement of said saw blade between said vertical and horizontal orientations reverses the direction in which power is provided by said engine to said propulsion means to reverse the direction in which said carriage is driven along said track mechanism.

15. A portable lumber milling machine according to claim 11 in which said saw blade is a rotary, disk-shaped blade, and said support means is rotatable relative to said carriage and said engine about an axis which is spaced from said saw blade a distance equal to the radius of said saw blade.

16. A portable sawmill comprising:

track mounting means having mountings adapted to be positioned a spaced distance apart relative to a transversely cut log which is to be longitudinally cut into lumber, a track mounted upon said track mounting means to extend parallel to said transversely cut log, a carriage mounted upon said track to ride longitudinally therealong, an engine mounted in fixed disposition on said carriage, a saw blade driven by said engine, an arbor rotatably mounted upon said carriage to carry said saw blade alternatively at a raised position for rotation about a horizontal axis and a lowered position for rotation about a vertical axis, releasable latching means for holding said arbor to carry said saw blade in said raised position, latch tripping means located at a predetermined position on said track for releasing said releasable latching means to automatically allow said arbor to fall in rotation due to the force of gravity to carry said saw blade from said raised to said lowered position when said carriage arrives at said predetermined position, propulsion means on said carriage, engageable with said engine, and drive control means operable from one end of said track to engage and disengage said propulsion means to control movement of said carriage along said track.

17. A portable sawmill according to claim 16 in which said propulsion means is continuously, variably adjustably from one end of said track.

18. A portable saw mill according to claim 11 in which said drive control means includes separate limit setting controls for maximum speed of carriage movement by said propulsion means when said saw blade is in each of said elevated and lowered positions.

19. A portable saw mill according to claim 16 in which said latch tripping means also reverses the direction in which said propulsion means drives said carriage along said track.

* * * * *